US006932702B1

(12) United States Patent
Harris

(10) Patent No.: US 6,932,702 B1
(45) Date of Patent: Aug. 23, 2005

(54) DEVICE AND METHOD FOR CONFIGURING A SLOT MACHINE HAVING A HOT STREAK PHASE

(76) Inventor: Gary Harris, 8128 Horizon Lake Dr., Las Vegas, NV (US) 89128

( * ) Notice: Subject to any disclaimer, the term of this patent is extended or adjusted under 35 U.S.C. 154(b) by 74 days.

(21) Appl. No.: 09/999,297

(22) Filed: Oct. 30, 2001

Related U.S. Application Data

(60) Provisional application No. 60/244,431, filed on Oct. 30, 2000, now abandoned, and provisional application No. 60/268,838, filed on Feb. 14, 2001, now abandoned.

(51) Int. Cl.[7] ..... A63F 9/24; G07F 17/32
(52) U.S. Cl. ..... 463/20; 463/16
(58) Field of Search ..... 463/16, 17, 18, 463/19, 20, 25; 273/138.1, 143

(56) References Cited

U.S. PATENT DOCUMENTS 5,423,539 A * 6/1995 Nagao ..... 463/20
5,655,961 A * 8/1997 Acres et al. ..... 463/27
5,725,428 A * 3/1998 Achmuller ..... 463/20
6,238,288 B1 * 5/2001 Walker et al. ..... 463/26
2002/0006822 A1 * 1/2002 Krintzman ..... 463/27
2002/0022514 A1 * 2/2002 Randall et al. ..... 463/20
2003/0130030 A1 * 7/2003 Delott et al. ..... 463/20

FOREIGN PATENT DOCUMENTS

WO WO 00/32286 * 6/2000 ..... A63F/9/22

* cited by examiner

*Primary Examiner*—Jessica J. Harrison
(74) *Attorney, Agent, or Firm*—Robert Ryan Morishita; Anderson & Morishita, LLC

(57) ABSTRACT

A game and method are set forth which includes a triggering event triggering a hot streak phase. During the hot streak phase, for a predetermined number of future games, the game is configured to provide at least one of consecutive wins or a multiplier applied to winning outcomes. By providing the hot streak feature the overall performance of the game can be configured to have the desired hit frequency and hold. In another aspect a nine reel, eight pay line game is set forth which uses three symbol data sets in an arrangement to provide for easier configuration to obtain, with or without a hot streak feature or other bonus features, a game having the desired performance.

13 Claims, 20 Drawing Sheets

*FIG. 2*

| SYMBOL | REEL 1 | REEL 2 | REEL 3 |
|---|---|---|---|
| DOUBLE | 1 | 1 | 1 |
| RED 7 | 4 | 2 | 2 |
| WILD BAR | 1 | 2 | 1 |
| BONUS | 4 | 1 | 0 |
| 3 BAR | 8 | 5 | 2 |
| 2 BAR | 4 | 5 | 10 |
| 1 BAR | 9 | 15 | 15 |
| CHERRY | 1 | 1 | 1 |
| RED | 4 | 1 | 1 |
| GOLD | 1 | 2 | 15 |
| BLUE | 1 | 15 | 5 |
| YELLOW | 13 | 2 | 2 |
| ORANGE | 4 | 5 | 5 |
| GREEN | 1 | 1 | 1 |
| PURPLE | 4 | 5 | 2 |
| SILVER | 4 | 1 | 1 |
| TOTAL | 64 | 64 | 64 |

36

REEL STRIP LAYOUT

| | 1 | 2 | 3 |
|---|---|---|---|
| 1 | DOUBLE | DOUBLE | JACKPOT |
| 2 | GREEN | RED | RED |
| 3 | WILD BAR | BONUS | WILD BAR |
| 4 | GOLD | GREEN | GREEN |
| 5 | CHERRY | CHERRY | CHERRY |
| 6 | BLUE | SILVER | SILVER |
| 7 | 1 BAR | 1 BAR | 1 BAR |
| 8 | YELLOW | BLUE | GOLD |
| 9 | BONUS | RED 7 | RED 7 |
| 10 | RED | GOLD | YELLOW |
| 11 | RED 7 | WILD BAR | 3 BAR |
| 12 | ORANGE | YELLOW | PURPLE |
| 13 | 3 BAR | 1 BAR | 1 BAR |
| 14 | YELLOW | BLUE | GOLD |
| 15 | 1 BAR | 3 BAR | 2 BAR |
| 16 | PURPLE | PURPLE | BLUE |
| 17 | 2 BAR | 2 BAR | 2 BAR |
| 18 | SILVER | ORANGE | ORANGE |
| 19 | 3 BAR | 1 BAR | 1 BAR |
| 20 | YELLOW | BLUE | GOLD |
| 21 | 1 BAR | 1 BAR | 1 BAR |
| 22 | YELLOW | BLUE | GOLD |

26

34

| REEL 1 | | | REEL 2 | | | REEL 3 | | |
|---|---|---|---|---|---|---|---|---|
| VIRTUAL REEL POSITION | SYMBOL | PHYSICAL POSITION USED | VIRTUAL REEL POSITION | SYMBOL | PHYSICAL POSITION USED | VIRTUAL REEL POSITION | SYMBOL | PHYSICAL POSITION USED |
| 1 | DOUBLE | 1 | 1 | DOUBLE | 1 | 1 | DOUBLE | 1 |
| 2 | GREEN | 2 | 2 | RED | 2 | 2 | RED | 2 |
| 3 | WILD BAR | 3 | 3 | BONUS | 3 | 3 | WILD BAR | 3 |
| 4 | GOLD | 4 | 4 | GREEN | 4 | 4 | GREEN | 4 |
| 5 | CHERRY | 5 | 5 | CHERRY | 5 | 5 | CHERRY | 5 |
| 6 | BLUE | 6 | 6 | SILVER | 6 | 6 | SILVER | 6 |
| 7 | 1 BAR | 7 | 7 | 1 BAR | 7 | 7 | 1 BAR | 7 |
| 8 | YELLOW | 8 | 8 | BLUE | 8 | 8 | GOLD | 8 |
| 9 | BONUS | 9 | 9 | RED 7 | 9 | 9 | RED 7 | 9 |
| 10 | RED | 10 | 10 | GOLD | 10 | 10 | YELLOW | 10 |
| 11 | RED 7 | 11 | 11 | WILD BAR | 11 | 11 | 3 BAR | 11 |
| 12 | ORANGE | 12 | 12 | YELLOW | 12 | 12 | PURPLE | 12 |
| 13 | 3 BAR | 13 | 13 | 1 BAR | 13 | 13 | 1 BAR | 13 |
| 14 | YELLOW | 14 | 14 | BLUE | 14 | 14 | GOLD | 14 |
| 15 | 1 BAR | 15 | 15 | 3 BAR | 15 | 15 | 2 BAR | 15 |
| 16 | PURPLE | 16 | 16 | PURPLE | 16 | 16 | BLUE | 16 |
| 17 | 2 BAR | 17 | 17 | 2 BAR | 17 | 17 | 2 BAR | 17 |
| 18 | SILVER | 18 | 18 | ORANGE | 18 | 18 | ORANGE | 18 |
| 19 | 3 BAR | 19 | 19 | 1 BAR | 19 | 19 | 1 BAR | 19 |
| 20 | YELLOW | 20 | 20 | BLUE | 20 | 20 | GOLD | 20 |
| 21 | 1 BAR | 21 | 21 | 1 BAR | 21 | 21 | 1 BAR | 21 |
| 22 | YELLOW | 8 | 22 | BLUE | 8 | 22 | GOLD | 8 |
| 23 | BONUS | 9 | 23 | RED 7 | 9 | 23 | RED 7 | 9 |
| 24 | RED | 10 | 24 | GOLD | 10 | 24 | YELLOW | 10 |
| 25 | RED 7 | 11 | 25 | WILD BAR | 11 | 25 | 3 BAR | 11 |
| 26 | ORANGE | 12 | 26 | YELLOW | 12 | 26 | PURPLE | 12 |
| 27 | 3 BAR | 13 | 27 | 1 BAR | 13 | 27 | 1 BAR | 13 |
| 28 | YELLOW | 14 | 28 | BLUE | 14 | 28 | GOLD | 14 |
| 29 | 1 BAR | 15 | 29 | 3 BAR | 15 | 29 | 2 BAR | 15 |
| 30 | PURPLE | 16 | 30 | PURPLE | 16 | 30 | BLUE | 16 |
| 31 | 2 BAR | 17 | 31 | 2 BAR | 17 | 31 | 2 BAR | 17 |
| 32 | SILVER | 18 | 32 | ORANGE | 18 | 32 | ORANGE | 18 |
| 33 | 3 BAR | 19 | 33 | 1 BAR | 19 | 33 | 1 BAR | 19 |
| 34 | YELLOW | 20 | 34 | BLUE | 20 | 34 | GOLD | 20 |
| 35 | 1 BAR | 21 | 35 | 1 BAR | 21 | 35 | 1 BAR | 21 |
| 36 | YELLOW | 8 | 36 | BLUE | 14 | 36 | GOLD | 14 |
| 37 | BONUS | 9 | 37 | 3 BAR | 15 | 37 | 2 BAR | 15 |
| 38 | RED | 10 | 38 | PURPLE | 16 | 38 | BLUE | 16 |
| 39 | RED 7 | 11 | 39 | 2 BAR | 17 | 39 | 2 BAR | 17 |
| 40 | ORANGE | 12 | 40 | ORANGE | 18 | 40 | ORANGE | 18 |
| 41 | 3 BAR | 13 | 41 | 1 BAR | 19 | 41 | 1 BAR | 19 |
| 42 | YELLOW | 14 | 42 | BLUE | 20 | 42 | GOLD | 20 |
| 43 | 1 BAR | 15 | 43 | 1 BAR | 21 | 43 | 1 BAR | 21 |
| 44 | PURPLE | 16 | 44 | BLUE | 14 | 44 | GOLD | 14 |
| 45 | 2 BAR | 17 | 45 | 3 BAR | 15 | 45 | 2 BAR | 15 |
| 46 | SILVER | 18 | 46 | PURPLE | 16 | 46 | BLUE | 16 |
| 47 | 3 BAR | 19 | 47 | 2 BAR | 17 | 47 | 2 BAR | 17 |
| 48 | YELLOW | 20 | 48 | ORANGE | 18 | 48 | ORANGE | 18 |
| 49 | 1 BAR | 21 | 49 | 1 BAR | 19 | 49 | 1 BAR | 19 |
| 50 | YELLOW | 8 | 50 | BLUE | 20 | 50 | GOLD | 20 |
| 51 | BONUS | 9 | 51 | 1 BAR | 21 | 51 | 1 BAR | 21 |
| 52 | RED | 10 | 52 | BLUE | 20 | 52 | GOLD | 20 |
| 53 | RED 7 | 11 | 53 | 1 BAR | 21 | 53 | 1 BAR | 21 |
| 54 | ORANGE | 12 | 54 | BLUE | 20 | 54 | GOLD | 20 |
| 55 | 3 BAR | 13 | 55 | 1 BAR | 21 | 55 | 1 BAR | 21 |
| 56 | YELLOW | 14 | 56 | BLUE | 14 | 56 | GOLD | 14 |
| 57 | 1 BAR | 15 | 57 | 3 BAR | 15 | 57 | 2 BAR | 15 |
| 58 | PURPLE | 16 | 58 | PURPLE | 16 | 58 | BLUE | 16 |
| 59 | 2 BAR | 17 | 59 | 2 BAR | 17 | 59 | 2 BAR | 17 |
| 60 | SILVER | 18 | 60 | ORANGE | 18 | 60 | ORANGE | 18 |
| 61 | 3 BAR | 19 | 61 | 1 BAR | 19 | 61 | 1 BAR | 19 |
| 62 | YELLOW | 20 | 62 | BLUE | 20 | 62 | GOLD | 20 |
| 63 | 1 BAR | 21 | 63 | 1 BAR | 21 | 63 | 1 BAR | 21 |
| 64 | YELLOW | 22 | 64 | BLUE | 22 | 64 | GOLD | 22 |

*FIG. 3*

TABLE A

| | REEL 1 | | | | REEL 2 | | | | REEL 2 | | | |
|---|---|---|---|---|---|---|---|---|---|---|---|---|
| | | STOP POSITION | | 84.9% | | STOP POSITION | | 84.9% | | STOP POSITION | | 84.9% |
| | PHYSICAL | FIRST | LAST | QTY. | PHYSICAL | FIRST | LAST | QTY. | PHYSICAL | FIRST | LAST | QTY. |
| 1 | DOUBLE | 1 | 1 | 1 | DOUBLE | 1 | 1 | 1 | DOUBLE | 1 | 1 | 1 |
| 2 | RED | 2 | 4 | 3 | RED | 2 | 4 | 3 | RED | 2 | 4 | 3 |
| 3 | 1 BAR | 5 | 5 | 1 | 1 BAR | 5 | 10 | 6 | 1 BAR | 5 | 9 | 5 |
| 4 | GOLD | 6 | 8 | 3 | GOLD | 11 | 13 | 3 | GOLD | 10 | 13 | 4 |
| 5 | 3 BAR | 9 | 11 | 3 | 3 BAR | 14 | 15 | 2 | 3 BAR | 14 | 14 | 1 |
| 6 | BLUE | 12 | 14 | 3 | BLUE | 16 | 17 | 2 | BLUE | 15 | 15 | 1 |
| 7 | CHERRY | 15 | 16 | 2 | CHERRY | 18 | 18 | 1 | CHERRY | 16 | 16 | 1 |
| 8 | YELLOW | 17 | 20 | 4 | YELLOW | 19 | 24 | 6 | YELLOW | 17 | 17 | 1 |
| 9 | 1 BAR | 21 | 22 | 2 | 1 BAR | 25 | 29 | 5 | 1 BAR | 18 | 23 | 6 |
| 10 | ORANGE | 23 | 26 | 4 | ORANGE | 30 | 31 | 2 | ORANGE | 24 | 26 | 3 |
| 11 | WILD BAR | 27 | 27 | 1 | WILD BAR | 32 | 32 | 1 | WILD BAR | 27 | 27 | 1 |
| 12 | GREEN | 28 | 29 | 2 | GREEN | 33 | 38 | 6 | GREEN | 28 | 28 | 1 |
| 13 | BONUS | 30 | 34 | 5 | BONUS | 39 | 40 | 2 | 1 BAR | 29 | 34 | 6 |
| 14 | PURPLE | 35 | 37 | 3 | PURPLE | 41 | 43 | 3 | PURPLE | 35 | 38 | 4 |
| 15 | 2 BAR | 38 | 44 | 7 | 2 BAR | 44 | 48 | 5 | 2 BAR | 39 | 42 | 4 |
| 16 | SILVER | 45 | 45 | 1 | SILVER | 49 | 51 | 3 | SILVER | 43 | 49 | 7 |
| 17 | RED 7 | 46 | 50 | 5 | RED 7 | 52 | 53 | 2 | RED 7 | 50 | 50 | 1 |
| 18 | PINK | 51 | 52 | 2 | PINK | 54 | 55 | 2 | PINK | 51 | 51 | 1 |
| 19 | 3 BAR | 53 | 55 | 3 | 3 BAR | 56 | 57 | 2 | 3 BAR | 52 | 52 | 1 |
| 20 | ROSE | 56 | 60 | 5 | ROSE | 58 | 58 | 1 | ROSE | 53 | 56 | 4 |
| 21 | 1 BAR | 61 | 62 | 2 | 1 BAR | 59 | 63 | 5 | 1 BAR | 57 | 61 | 5 |
| 22 | TAN | 63 | 64 | 2 | TAN | 64 | 64 | 1 | TAN | 62 | 64 | 3 |
| | | | | 64 | | | | 64 | | | | 64 |

FIG. 4A

| COMBINATION | | | | | | 85.87% GAME | | | | | |
|---|---|---|---|---|---|---|---|---|---|---|---|
| REEL 1 | REEL 2 | REEL 3 | REEL 1 | REEL 2 | REEL 3 | HITS | SUB | TOTAL | PAY | WIN | % |
| DOUBLE | DOUBLE | DOUBLE | 1 | 1 | 1 | 1 | | 1 | 1000 | 1000 | 0.38% |
| RED 7 | RED 7 | RED 7 | 4 | 2 | 2 | 16 | | 16 | 100 | 1600 | 0.61% |
| DOUBLE | DOUBLE | RED 7 | 1 | 1 | 2 | 2 | | 2 | 400 | 800 | 0.31% |
| RED 7 | DOUBLE | DOUBLE | 4 | 1 | 1 | 4 | | 4 | 400 | 1600 | 0.61% |
| DOUBLE | RED 7 | DOUBLE | 1 | 2 | 1 | 2 | | 2 | 400 | 800 | 0.31% |
| RED 7 | RED 7 | DOUBLE | 4 | 2 | 1 | 8 | | 8 | 200 | 1600 | 0.61% |
| DOUBLE | RED 7 | RED 7 | 1 | 2 | 2 | 4 | | 4 | 200 | 800 | 0.31% |
| RED 7 | DOUBLE | RED 7 | 4 | 1 | 2 | 8 | | 8 | 200 | 1600 | 0.61% |
| 3 BAR | 3 BAR | 3 BAR | 9 | 7 | 3 | 189 | 2 | 187 | 40 | 7480 | 2.85% |
| DOUBLE | DOUBLE | 3 BAR | 1 | 1 | 3 | 3 | 1 | 2 | 160 | 320 | 0.12% |
| 3 BAR | DOUBLE | DOUBLE | 9 | 1 | 1 | 9 | 1 | 8 | 160 | 1280 | 0.49% |
| DOUBLE | 3 BAR | DOUBLE | 1 | 7 | 1 | 7 | 2 | 5 | 160 | 800 | 0.31% |
| 3 BAR | 3 BAR | DOUBLE | 9 | 7 | 1 | 63 | 2 | 61 | 80 | 4880 | 1.86% |
| DOUBLE | 3 BAR | 3 BAR | 1 | 7 | 3 | 21 | 2 | 19 | 80 | 1520 | 0.58% |
| 3 BAR | DOUBLE | 3 BAR | 9 | 1 | 3 | 27 | 1 | 26 | 80 | 2080 | 0.79% |
| 2 BAR | 2 BAR | 2 BAR | 5 | 7 | 11 | 385 | 2 | 383 | 20 | 7660 | 2.92% |
| DOUBLE | DOUBLE | 2 BAR | 1 | 1 | 11 | 11 | 1 | 10 | 80 | 800 | 0.31% |
| 2 BAR | DOUBLE | DOUBLE | 5 | 1 | 1 | 5 | 1 | 4 | 80 | 320 | 0.12% |
| DOUBLE | 2 BAR | DOUBLE | 1 | 7 | 1 | 7 | 2 | 5 | 80 | 400 | 0.15% |
| 2 BAR | 2 BAR | DOUBLE | 5 | 7 | 1 | 35 | 2 | 33 | 40 | 1320 | 0.50% |
| DOUBLE | 2 BAR | 2 BAR | 1 | 7 | 11 | 77 | 2 | 75 | 40 | 3000 | 1.14% |
| 2 BAR | DOUBLE | 2 BAR | 5 | 1 | 11 | 55 | 1 | 54 | 40 | 2160 | 0.82% |
| 1 BAR | 1 BAR | 1 BAR | 10 | 17 | 16 | 2720 | 2 | 2718 | 10 | 27180 | 10.37% |
| DOUBLE | DOUBLE | 1 BAR | 1 | 1 | 16 | 16 | 1 | 15 | 40 | 600 | 0.23% |
| 1 BAR | DOUBLE | DOUBLE | 10 | 1 | 1 | 10 | 1 | 9 | 40 | 360 | 0.14% |
| DOUBLE | 1 BAR | DOUBLE | 1 | 17 | 1 | 17 | 2 | 15 | 40 | 600 | 0.23% |
| 1 BAR | 1 BAR | DOUBLE | 10 | 17 | 1 | 170 | 2 | 168 | 20 | 3360 | 1.28% |
| DOUBLE | 1 BAR | 1 BAR | 1 | 17 | 16 | 272 | 2 | 270 | 20 | 5400 | 2.06% |
| 1 BAR | DOUBLE | 1 BAR | 10 | 1 | 16 | 160 | 1 | 159 | 20 | 3180 | 1.21% |
| ANY BAR | ANY BAR | ANY BAR | 22 | 27 | 28 | 16632 | 3290 | 13342 | 5 | 66710 | 25.45% |
| DOUBLE | ANY BAR | ANY BAR | 1 | 27 | 28 | 756 | 366 | 390 | 10 | 3900 | 1.49% |
| ANY BAR | ANY BAR | DOUBLE | 22 | 27 | 1 | 594 | 264 | 330 | 10 | 3300 | 1.26% |
| ANY BAR | DOUBLE | ANY BAR | 22 | 1 | 28 | 616 | 240 | 376 | 10 | 3760 | 1.43% |
| CHERRY | CHERRY | CHERRY | 1 | 1 | 1 | 1 | | 1 | 20 | 20 | 0.01% |
| DOUBLE | DOUBLE | CHERRY | 1 | 1 | 1 | 1 | | 1 | 80 | 80 | 0.03% |
| CHERRY | DOUBLE | DOUBLE | 1 | 1 | 1 | 1 | | 1 | 80 | 80 | 0.03% |
| DOUBLE | CHERRY | DOUBLE | 1 | 1 | 1 | 1 | | 1 | 80 | 80 | 0.03% |
| CHERRY | CHERRY | DOUBLE | 1 | 1 | 1 | 1 | | 1 | 40 | 40 | 0.02% |
| DOUBLE | CHERRY | CHERRY | 1 | 1 | 1 | 1 | | 1 | 40 | 40 | 0.02% |
| CHERRY | DOUBLE | CHERRY | 1 | 1 | 1 | 1 | | 1 | 40 | 40 | 0.02% |
| CHERRY | DOUBLE | | 1 | 1 | 62 | 62 | | 62 | 10 | 620 | 0.24% |

FIG. 4B

| | | | | | | | | | | | |
|---|---|---|---|---|---|---|---|---|---|---|---|
| CHERRY | | DOUBLE | 1 | 62 | 1 | 62 | | 62 | 10 | 620 | 0.24% |
| DOUBLE | CHERRY | | 1 | 1 | 62 | 62 | | 62 | 10 | 620 | 0.24% |
| | CHERRY | DOUBLE | 62 | 1 | 1 | 62 | | 62 | 10 | 620 | 0.24% |
| DOUBLE | | CHERRY | 1 | 61 | 1 | 61 | 1 | 60 | 10 | 600 | 0.23% |
| | DOUBLE | CHERRY | 58 | 1 | 1 | 58 | 4 | 54 | 10 | 540 | 0.21% |
| CHERRY | CHERRY | | 1 | 1 | 62 | 62 | | 62 | 5 | 310 | 0.12% |
| | CHERRY | CHERRY | 62 | 1 | 1 | 62 | | 62 | 5 | 310 | 0.12% |
| CHERRY | | CHERRY | 1 | 62 | 1 | 62 | | 62 | 5 | 310 | 0.12% |
| CHERRY | | | 1 | 62 | 62 | 3844 | | 3844 | 2 | 7688 | 2.93% |
| | CHERRY | | 62 | 1 | 62 | 3844 | | 3844 | 2 | 7688 | 2.93% |
| | | CHERRY | 62 | 62 | 1 | 3844 | 4 | 3840 | 2 | 7680 | 2.93% |
| WILD BAR | WILD BAR | WILD BAR | 1 | 2 | 1 | 2 | | 2 | 50 | 100 | 0.04% |
| DOUBLE | DOUBLE | WILD BAR | 1 | 1 | 1 | 1 | | 1 | 200 | 200 | 0.08% |
| WILD BAR | DOUBLE | DOUBLE | 1 | 1 | 1 | 1 | | 1 | 200 | 200 | 0.08% |
| DOUBLE | WILD BAR | DOUBLE | 1 | 2 | 1 | 2 | | 2 | 200 | 400 | 0.15% |
| WILD BAR | WILD BAR | DOUBLE | 1 | 2 | 1 | 2 | | 2 | 100 | 200 | 0.08% |
| DOUBLE | WILD BAR | WILD BAR | 1 | 2 | 1 | 2 | | 2 | 100 | 200 | 0.08% |
| WILD BAR | DOUBLE | WILD BAR | 1 | 1 | 1 | 1 | | 1 | 100 | 100 | 0.04% |
| BONUS | BONUS | DOUBLE | 4 | 1 | 1 | 4 | | 4 | 200 | 800 | 0.31% |
| BONUS | BONUS | WILD BAR | 4 | 1 | 1 | 4 | | 4 | 100 | 400 | 0.15% |
| BONUS | BONUS | RED 7 | 4 | 1 | 2 | 8 | | 8 | 200 | 1600 | 0.61% |
| BONUS | BONUS | 3 BAR | 4 | 1 | 2 | 8 | | 8 | 80 | 640 | 0.24% |
| BONUS | BONUS | 2 BAR | 4 | 1 | 10 | 40 | | 40 | 40 | 1600 | 0.61% |
| BONUS | BONUS | CHERRY | 4 | 1 | 1 | 4 | | 4 | 40 | 160 | 0.06% |
| BONUS | BONUS | 1 BAR | 4 | 1 | 15 | 60 | | 60 | 20 | 1200 | 0.46% |
| BONUS | BONUS | * BLANK | 4 | 1 | 32 | 128 | | 128 | 10 | 1280 | 0.49% |
| DOUBLE | BONUS | DOUBLE | 1 | 1 | 1 | 1 | | 1 | 400 | 400 | 0.15% |
| DOUBLE | BONUS | WILD BAR | 1 | 1 | 1 | 1 | | 1 | 200 | 200 | 0.08% |
| DOUBLE | BONUS | RED 7 | 1 | 1 | 2 | 2 | | 2 | 400 | 800 | 0.31% |
| DOUBLE | BONUS | 3 BAR | 1 | 1 | 2 | 2 | | 2 | 160 | 320 | 0.12% |
| DOUBLE | BONUS | 2 BAR | 1 | 1 | 10 | 10 | | 10 | 80 | 800 | 0.31% |
| DOUBLE | BONUS | CHERRY | 1 | 1 | 1 | 1 | | 1 | 80 | 80 | 0.03% |
| DOUBLE | BONUS | 1 BAR | 1 | 1 | 15 | 15 | | 15 | 40 | 600 | 0.23% |
| DOUBLE | BONUS | * BLANK | 1 | 1 | 32 | 32 | | 32 | 20 | 640 | 0.24% |
| BONUS | DOUBLE | DOUBLE | 4 | 1 | 1 | 4 | | 4 | 400 | 1600 | 0.61% |
| BONUS | DOUBLE | WILD BAR | 4 | 1 | 1 | 4 | | 4 | 200 | 800 | 0.31% |
| BONUS | DOUBLE | RED 7 | 4 | 1 | 2 | 8 | | 8 | 400 | 3200 | 1.22% |
| BONUS | DOUBLE | 3 BAR | 4 | 1 | 2 | 8 | | 8 | 160 | 1280 | 0.49% |
| BONUS | DOUBLE | 2 BAR | 4 | 1 | 10 | 40 | | 40 | 80 | 3200 | 1.22% |
| BONUS | DOUBLE | CHERRY | 4 | 1 | 1 | 4 | | 4 | 80 | 320 | 0.12% |
| BONUS | DOUBLE | 1 BAR | 4 | 1 | 15 | 60 | | 60 | 40 | 2400 | 0.92% |
| BONUS | DOUBLE | * BLANK | 4 | 1 | 32 | 128 | | 128 | 20 | 2560 | 0.98% |

*FIG. 4C*

| | | | | | | | | | | |
|---|---|---|---|---|---|---|---|---|---|---|
| RED | RED | | DOUBLE | 3 | 3 | 1 | 9 | 9 | 10 | 90 | 0.03% |
| GOLD | GOLD | | DOUBLE | 3 | 3 | 1 | 9 | 9 | 10 | 90 | 0.03% |
| BLUE | BLUE | | DOUBLE | 3 | 2 | 1 | 6 | 6 | 10 | 60 | 0.02% |
| YELLOW | YELLOW | | DOUBLE | 4 | 6 | 1 | 24 | 24 | 10 | 240 | 0.09% |
| ORANGE | ORANGE | | DOUBLE | 4 | 2 | 1 | 8 | 8 | 10 | 80 | 0.03% |
| GREEN | GREEN | | DOUBLE | 2 | 6 | 1 | 12 | 12 | 10 | 120 | 0.05% |
| PURPLE | PURPLE | | DOUBLE | 3 | 3 | 1 | 9 | 9 | 10 | 90 | 0.03% |
| SILVER | SILVER | | DOUBLE | 1 | 3 | 1 | 3 | 3 | 10 | 30 | 0.01% |
| PINK | PINK | | DOUBLE | 2 | 2 | 1 | 4 | 4 | 10 | 40 | 0.02% |
| ROSE | ROSE | | DOUBLE | 5 | 1 | 1 | 5 | 5 | 10 | 50 | 0.02% |
| TAN | TAN | | DOUBLE | 2 | 1 | 1 | 2 | 2 | 10 | 20 | 0.01% |
| DOUBLE | RED | | DOUBLE | 1 | 3 | 1 | 3 | 3 | 20 | 60 | 0.02% |
| DOUBLE | GOLD | | DOUBLE | 1 | 3 | 1 | 3 | 3 | 20 | 60 | 0.02% |
| DOUBLE | BLUE | | DOUBLE | 1 | 2 | 1 | 2 | 2 | 20 | 40 | 0.02% |
| DOUBLE | YELLOW | | DOUBLE | 1 | 6 | 1 | 6 | 6 | 20 | 120 | 0.05% |
| DOUBLE | ORANGE | | DOUBLE | 1 | 2 | 1 | 2 | 2 | 20 | 40 | 0.02% |
| DOUBLE | GREEN | | DOUBLE | 1 | 6 | 1 | 6 | 6 | 20 | 120 | 0.05% |
| DOUBLE | PURPLE | | DOUBLE | 1 | 3 | 1 | 3 | 3 | 20 | 60 | 0.02% |
| DOUBLE | SILVER | | DOUBLE | 1 | 3 | 1 | 3 | 3 | 20 | 60 | 0.02% |
| DOUBLE | PINK | | DOUBLE | 1 | 2 | 1 | 2 | 2 | 20 | 40 | 0.02% |
| DOUBLE | ROSE | | DOUBLE | 1 | 1 | 1 | 1 | 1 | 20 | 20 | 0.01% |
| DOUBLE | TAN | | DOUBLE | 1 | 1 | 1 | 1 | 1 | 20 | 20 | 0.01% |
| RED | DOUBLE | | DOUBLE | 3 | 1 | 1 | 3 | 3 | 20 | 60 | 0.02% |
| GOLD | DOUBLE | | DOUBLE | 3 | 1 | 1 | 3 | 3 | 20 | 60 | 0.02% |
| BLUE | DOUBLE | | DOUBLE | 3 | 1 | 1 | 3 | 3 | 20 | 60 | 0.02% |
| YELLOW | DOUBLE | | DOUBLE | 4 | 1 | 1 | 4 | 4 | 20 | 80 | 0.03% |
| ORANGE | DOUBLE | | DOUBLE | 4 | 1 | 1 | 4 | 4 | 20 | 80 | 0.03% |
| GREEN | DOUBLE | | DOUBLE | 2 | 1 | 1 | 2 | 2 | 20 | 40 | 0.02% |
| PURPLE | DOUBLE | | DOUBLE | 3 | 1 | 1 | 3 | 3 | 20 | 60 | 0.02% |
| SILVER | DOUBLE | | DOUBLE | 1 | 1 | 1 | 1 | 1 | 20 | 20 | 0.01% |
| PINK | DOUBLE | | DOUBLE | 2 | 1 | 1 | 2 | 2 | 20 | 40 | 0.02% |
| ROSE | DOUBLE | | DOUBLE | 5 | 1 | 1 | 5 | 5 | 20 | 100 | 0.04% |
| TAN | DOUBLE | | DOUBLE | 2 | 1 | 1 | 2 | 2 | 20 | 40 | 0.02% |
| | | | | | | | 37481 | 33940 | | 222674 | 84.94% |

*FIG.5*

| STREAK | COMBINATION REEL 1 | COMBINATION REEL 2 | COMBINATION REEL 3 | BLANK DISTRIBUTION OF PLAYS REEL 1 | REEL 2 | REEL 3 | HITS | PAY | GAME PERCENTAGE GAMES | H.F. | WIN/TRIG | TOTAL | 91.181% |
|---|---|---|---|---|---|---|---|---|---|---|---|---|---|
| TRIGGER 1 | RED | RED | RED | 3 | 3 | 3 | 63 | 14.22 | 2 | 100% | 28.44 | 1791.56 | 0.68% |
| TRIGGER 2 | GOLD | GOLD | GOLD | 3 | 3 | 4 | 79 | 14.22 | 2 | 100% | 28.44 | 2246.56 | 0.86% |
| TRIGGER 3 | BLUE | BLUE | BLUE | 3 | 2 | 1 | 23 | 14.22 | 2 | 100% | 28.44 | 654.06 | 0.25% |
| TRIGGER 4 | YELLOW | YELLOW | YELLOW | 4 | 6 | 1 | 69 | 14.22 | 2 | 100% | 28.44 | 1962.19 | 0.75% |
| TRIGGER 5 | ORANGE | ORANGE | ORANGE | 4 | 2 | 3 | 59 | 14.22 | 2 | 100% | 28.44 | 1677.81 | 0.64% |
| TRIGGER 6 | GREEN | GREEN | GREEN | 2 | 6 | 1 | 41 | 14.22 | 2 | 100% | 28.44 | 1165.94 | 0.44% |
| TRIGGER 7 | PURPLE | PURPLE | PURPLE | 3 | 3 | 4 | 79 | 14.22 | 2 | 100% | 28.44 | 2246.56 | 0.86% |
| TRIGGER 8 | SILVER | SILVER | SILVER | 1 | 3 | 7 | 63 | 14.22 | 2 | 100% | 28.44 | 1791.56 | 0.68% |
| TRIGGER 9 | PINK | PINK | PINK | 2 | 2 | 1 | 17 | 14.22 | 2 | 100% | 28.44 | 483.44 | 0.18% |
| TRIGGER 10 | ROSE | ROSE | ROSE | 5 | 1 | 4 | 59 | 14.22 | 2 | 100% | 28.44 | 1677.81 | 0.64% |
| TRIGGER 11 | TAN | TAN | TAN | 1 | 1 | 3 | 23 | 14.22 | 2 | 100% | 28.44 | 654.06 | 0.25% |
| | BL | BL | BL | 32 | 32 | 32 | 575 | HITS | 1150.00 | | | 16351.56 | |
| | | | | 32 | 32 | 32 | | GAMES | 455.90 | AVE. PAY | 87.86 | | |

| | |
|---|---|
| STREAK | 6.24% |
| BASE | 84.94% |
| TOTAL% | 91.181% |

*FIG. 6*

| | GAMES | WIN/TRIG | TOTAL | 92.060% |
|---|---|---|---|---|
| RED | 2 | 28.44 | 1791.56 | 0.68% |
| GOLD | 2 | 28.44 | 2246.56 | 0.86% |
| BLUE | 4 | 56.88 | 1308.13 | 0.50% |
| YELLOW | 2 | 28.44 | 1962.19 | 0.75% |
| ORANGE | 2 | 28.44 | 1677.81 | 0.64% |
| GREEN | 2 | 28.44 | 1165.94 | 0.44% |
| PURPLE | 2 | 28.44 | 2246.56 | 0.86% |
| SILVER | 2 | 28.44 | 1791.56 | 0.68% |
| PINK | 4 | 56.88 | 966.88 | 0.37% |
| ROSE | 3 | 42.66 | 2516.72 | 0.96% |
| TAN | 3 | 42.66 | 981.09 | 0.37% |

HITS 1312.00 18655.00
AVE. PAY 99.88
STREAK 7.12%
BASE 84.94%
TOTAL% 92.060%

| | GAMES | WIN/TRIG | TOTAL | 92.072% |
|---|---|---|---|---|
| RED | 3 | 42.66 | 2687.34 | 1.03% |
| GOLD | 3 | 42.66 | 3369.84 | 1.29% |
| BLUE | 3 | 42.66 | 981.09 | 0.37% |
| YELLOW | 3 | 42.66 | 2943.28 | 1.12% |
| ORANGE | 3 | 42.66 | 2516.72 | 0.96% |
| GREEN | 3 | 42.66 | 1748.91 | 0.67% |
| PURPLE | 3 | 42.66 | 3369.84 | 1.29% |
| SILVER | 3 | 42.66 | 2687.34 | 1.03% |
| PINK | 4 | 56.88 | 966.88 | 0.37% |
| ROSE | 2 | 28.44 | 1677.81 | 0.64% |
| TAN | 3 | 42.66 | 981.09 | 0.37% |

HITS 1683.00 23930.16
AVE. PAY 127.40
STREAK 9.13%
BASE 84.94%
TOTAL% 94.072%

| | GAMES | WIN/TRIG | TOTAL | 95.048% |
|---|---|---|---|---|
| RED | 3 | 42.66 | 2687.34 | 1.03% |
| GOLD | 3 | 42.66 | 3369.84 | 1.29% |
| BLUE | 4 | 56.88 | 1308.13 | 0.50% |
| YELLOW | 3 | 42.66 | 2943.28 | 1.12% |
| ORANGE | 3 | 42.66 | 2516.72 | 0.96% |
| GREEN | 4 | 56.88 | 2331.88 | 0.89% |
| PURPLE | 3 | 42.66 | 3369.84 | 1.29% |
| SILVER | 3 | 42.66 | 2687.34 | 1.03% |
| PINK | 6 | 85.31 | 1450.31 | 0.55% |
| ROSE | 3 | 42.66 | 2516.72 | 0.96% |
| TAN | 4 | 56.88 | 1308.13 | 0.50% |

HITS 1863.00 26489.53
AVE. PAY 140.75
STREAK 10.10%
BASE 84.94%
TOTAL% 95.048%

| | GAMES | WIN/TRIG | TOTAL | 92.008% |
|---|---|---|---|---|
| RED | 4 | 56.88 | 3583.13 | 1.37% |
| GOLD | 4 | 56.88 | 4493.13 | 1.71% |
| BLUE | 4 | 56.88 | 1308.13 | 0.50% |
| YELLOW | 4 | 56.88 | 3924.38 | 1.50% |
| ORANGE | 3 | 42.66 | 2516.72 | 0.96% |
| GREEN | 4 | 56.88 | 2331.88 | 0.89% |
| PURPLE | 3 | 42.66 | 3369.84 | 1.29% |
| SILVER | 3 | 42.66 | 2687.34 | 1.03% |
| PINK | 4 | 56.88 | 966.88 | 0.37% |
| ROSE | 3 | 42.66 | 2516.72 | 0.96% |
| TAN | 4 | 56.88 | 1308.13 | 0.50% |

HITS 2040.00 29006.25
AVE. PAY 153.89
STREAK 11.07%
BASE 84.94%
TOTAL% 96.008%

*FIG. 7*

92.086%

| | GAMES | TOTAL | % |
|---|---|---|---|
| RED | 31 | 212.96 | 0.08% |
| GOLD | 31 | 1597.20 | 0.61% |
| BLUE | 31 | 3993.01 | 1.52% |
| YELLOW | 31 | 2768.49 | 1.06% |
| ORANGE | 31 | 5324.01 | 2.03% |
| GREEN | 31 | 53.24 | 0.02% |
| PURPLE | 31 | 2129.60 | 0.81% |
| SILVER | 31 | 212.96 | 0.08% |

PAY 16291.47
HITS 1161.69

6.21%
BASE 85.87%
TOTAL% 92.086%

92.091%

| | GAMES | TOTAL | % |
|---|---|---|---|
| RED | 41 | 281.66 | 0.11% |
| GOLD | 41 | 2112.43 | 0.81% |
| BLUE | 41 | 5281.07 | 2.01% |
| YELLOW | 41 | 3661.54 | 1.40% |
| ORANGE | 41 | 7041.43 | 2.69% |
| GREEN | 41 | 70.41 | 0.03% |
| PURPLE | 41 | 2816.57 | 1.07% |
| SILVER | 41 | 281.66 | 0.11% |

PAY 21546.78
HITS 1536.42

8.22%
BASE 85.87%
TOTAL% 94.091%

95.093%

| | GAMES | TOTAL | % |
|---|---|---|---|
| RED | 46 | 316.01 | 0.12% |
| GOLD | 46 | 2370.04 | 0.90% |
| BLUE | 46 | 5925.11 | 2.26% |
| YELLOW | 46 | 4108.07 | 1.57% |
| ORANGE | 46 | 7900.14 | 3.01% |
| GREEN | 46 | 79.00 | 0.03% |
| PURPLE | 46 | 3160.06 | 1.21% |
| SILVER | 46 | 316.01 | 0.12% |

PAY 24174.44
HITS 1723.79

9.22%
BASE 85.87%
TOTAL% 95.093%

96.095%

| | GAMES | TOTAL | % |
|---|---|---|---|
| RED | 51 | 350.35 | 0.13% |
| GOLD | 51 | 2627.66 | 1.00% |
| BLUE | 51 | 6569.14 | 2.51% |
| YELLOW | 51 | 4554.60 | 1.74% |
| ORANGE | 51 | 8758.85 | 3.34% |
| GREEN | 51 | 87.59 | 0.03% |
| PURPLE | 51 | 3503.54 | 1.34% |
| SILVER | 51 | 350.35 | 0.13% |

PAY 26802.10
HITS 1911.16

10.22%
BASE 85.87%
TOTAL% 96.095%

*FIG. 8*

TRIGGER HIT WITH 1 COIN PLAY

| "HOT MULT" | BET 1 | BET 2 | BET 3 | BET 4 | BET 4 |
|---|---|---|---|---|---|
| X2 | 2 | 3 | 4 | 5 | 6 |
| X3 | 3 | 4 | 5 | 6 | 7 |
| X4 | 4 | 5 | 6 | 7 | 8 |
| X5 | 5 | 6 | 7 | 8 | 9 |
| X10 | 10 | 11 | 12 | 13 | 14 |

TRIGGER HIT WITH 2 COIN PLAY

| "HOT MULT" | BET 1 | BET 2 | BET 3 | BET 4 | BET 4 |
|---|---|---|---|---|---|
| X2 | 2 | 4 | 5 | 6 | 7 |
| X3 | 3 | 6 | 7 | 8 | 9 |
| X4 | 4 | 8 | 9 | 10 | 11 |
| X5 | 5 | 10 | 11 | 12 | 13 |
| X10 | 10 | 20 | 21 | 22 | 23 |

TRIGGER HIT WITH 3 COIN PLAY

| "HOT MULT" | BET 1 | BET 2 | BET 3 | BET 4 | BET 4 |
|---|---|---|---|---|---|
| X2 | 2 | 4 | 6 | 7 | 8 |
| X3 | 3 | 6 | 9 | 10 | 11 |
| X4 | 4 | 8 | 12 | 13 | 14 |
| X5 | 5 | 10 | 15 | 16 | 17 |
| X10 | 10 | 20 | 30 | 31 | 32 |

TRIGGER HIT WITH 4 COIN PLAY

| "HOT MULT" | BET 1 | BET 2 | BET 3 | BET 4 | BET 4 |
|---|---|---|---|---|---|
| X2 | 2 | 4 | 6 | 8 | 9 |
| X3 | 3 | 6 | 9 | 12 | 13 |
| X4 | 4 | 8 | 12 | 16 | 17 |
| X5 | 5 | 10 | 15 | 20 | 21 |
| X10 | 10 | 20 | 30 | 40 | 41 |

TRIGGER HIT WITH 5 COIN PLAY

| "HOT MULT" | BET 1 | BET 2 | BET 3 | BET 4 | BET 4 |
|---|---|---|---|---|---|
| X2 | 2 | 4 | 6 | 8 | 10 |
| X3 | 3 | 6 | 9 | 12 | 15 |
| X4 | 4 | 8 | 12 | 16 | 20 |
| X5 | 5 | 10 | 15 | 20 | 25 |
| X10 | 10 | 20 | 30 | 40 | 50 |

*FIG. 10*

TABLE 1

| | REEL 1 | REEL 2 | REEL 3 | GAME % |
|---|---|---|---|---|
| STAR | 2 | 2 | 2 | 0.15% |
| BLUE 7 | 2 | 2 | 1 | 0.76% |
| WILD BAR | 3 | 2 | 2 | 0.23% |
| 3 BAR | 4 | 3 | 4 | 3.02% |
| 2 BAR | 5 | 4 | 10 | 4.30% |
| 1 BAR | 9 | 13 | 11 | 8.88% |
| ANY BAR | | | | 17.88% |
| CHERRY | 2 | 1 | 1 | 12.62% |
| BONUS | 1 | | | 10.29% |
| BONUS | | 1 | | 1.50% |
| FRUIT 7 | 2 | 1 | 1 | 0.08% |
| ANY 7 | | | | 0.34% |
| ORANGE | 10 | 12 | 10 | 3.27% |
| PLUM | 11 | 10 | 10 | 6.00% |
| BELL | 7 | 6 | 7 | 3.85% |
| TARGET | 6 | 7 | 5 | 5.86% |
| *BLANK | 0 | 0 | 0 | 0.83% |
| STOPS | 64 | 64 | 64 | 79.86% |

CALCULATION FOR LINE 1–7

TABLE 2

| | REEL 3 | REEL 3 | REEL 3 | GAME % |
|---|---|---|---|---|
| STAR | 2 | 2 | 2 | 0.15% |
| BLUE 7 | 1 | 1 | 1 | 0.19% |
| WILD BAR | 2 | 2 | 2 | 0.15% |
| 3 BAR | 4 | 4 | 4 | 3.17% |
| 2 BAR | 10 | 10 | 10 | 13.12% |
| 1 BAR | 11 | 11 | 11 | 8.35% |
| ANY BAR | | | | 29.67% |
| CHERRY | 1 | 1 | 1 | 9.45% |
| BONUS | 0 | 0 | 0 | 0.00% |
| BONUS | 0 | 0 | 0 | 0.00% |
| FRUIT 7 | 1 | 1 | 1 | 0.04% |
| ANY 7 | | | | 0.11% |
| ORANGE | 10 | 10 | 10 | 2.54% |
| PLUM | 10 | 10 | 10 | 5.08% |
| BELL | 7 | 7 | 7 | 3.91% |
| TARGET | 5 | 5 | 5 | 3.30% |
| *BLANK | 0 | 0 | 0 | 1.61% |
| STOPS | 64 | 64 | 64 | 80.85% |

CALCULATION FOR LINE 8

| | CALCULATION | | | % |
|---|---|---|---|---|
| LINE 1 | REEL 1 | REEL 3 | REEL 2 | 79.86% |
| LINE 2 | REEL 3 | REEL 2 | REEL 1 | 79.86% |
| LINE 3 | REEL 2 | REEL 1 | REEL 3 | 79.86% |
| LINE 4 | REEL 3 | REEL 1 | REEL 2 | 79.86% |
| LINE 5 | REEL 2 | REEL 3 | REEL 1 | 79.86% |
| LINE 6 | REEL 1 | REEL 2 | REEL 3 | 79.86% |
| LINE 7 | REEL 2 | REEL 3 | REEL 1 | 79.86% |
| LINE 8 | REEL 3 | REEL 3 | REEL 3 | 80.85% |

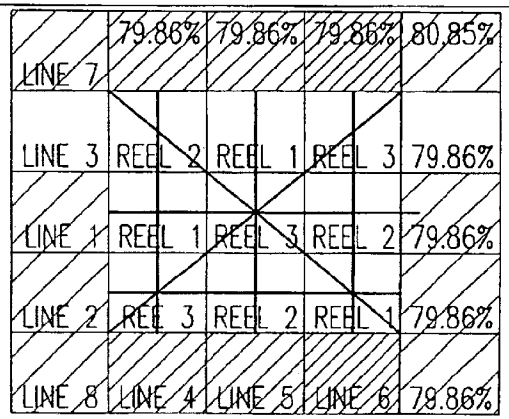

*FIG. 11*

| | | | REEL 1 | REEL 2 | REEL 3 |
|---|---|---|---|---|---|
| TRIGGER 1 | RED | 1 | 12 | 5 | 12 |
| TRIGGER 2 | GOLD | 2 | 11 | 12 | 4 |
| TRIGGER 3 | BLUE | 3 | 16 | 9 | 13 |
| TRIGGER 4 | YELLOW | 4 | 7 | 13 | 11 |
| TRIGGER 5 | ORANGE | 5 | 18 | 4 | 17 |
| TRIGGER 6 | LT GREEN | 6 | 3 | 14 | 1 |
| TRIGGER 7 | PURPLE | 7 | 15 | 11 | 15 |
| TRIGGER 8 | LIME | 8 | 4 | 19 | 2 |
| TRIGGER 9 | ROSE | 9 | 13 | 10 | 16 |
| TRIGGER 10 | TAN | 10 | 8 | 16 | 10 |
| TRIGGER 11 | PINK | 11 | 17 | 6 | 14 |
| TRIGGER 12 | BR. ORANGE | 12 | 6 | 18 | 7 |
| TRIGGER 13 | DK YELLOW | 13 | 14 | 7 | 18 |
| TRIGGER 14 | MAROON | 14 | 1 | 17 | 9 |
| TRIGGER 15 | DK BLUE | 15 | 22 | 8 | 22 |
| TRIGGER 16 | SEA GREEN | 16 | 5 | 22 | 5 |
| TRIGGER 17 | BR GREEN | 17 | 19 | 3 | 19 |
| TRIGGER 18 | TEAL | 18 | 10 | 15 | 3 |
| TRIGGER 19 | PALE BLUE | 19 | 20 | 2 | 21 |
| TRIGGER 20 | WHITE | 20 | 2 | 20 | 8 |
| TRIGGER 21 | GREY | 21 | 21 | 1 | 20 |
| TRIGGER 22 | AQUA | 22 | 9 | 21 | 6 |

*FIG. 12*

| PAY | | COMBINATION REEL 1 | REEL 2 | REEL 3 | COLOR OVERLAY DISTRIBUTION OF PAYS REEL 1 | REEL 2 | REEL 3 | HITS | PAY |
|---|---|---|---|---|---|---|---|---|---|
| 2 | TRIGGER 1 | RED | RED | RED | 3 | 3 | 3 | 27 | 12.26 |
| 2 | TRIGGER 2 | GOLD | GOLD | GOLD | 3 | 2 | 3 | 18 | 12.26 |
| 2 | TRIGGER 3 | BLUE | BLUE | BLUE | 4 | 2 | 3 | 24 | 12.26 |
| 2 | TRIGGER 4 | YELLOW | YELLOW | YELLOW | 5 | 1 | 4 | 20 | 12.26 |
| 2 | TRIGGER 5 | ORANGE | ORANGE | ORANGE | 4 | 2 | 2 | 16 | 12.26 |
| 2 | TRIGGER 6 | LT. GREEN | LT. GREEN | LT. GREEN | 1 | 2 | 1 | 2 | 12.26 |
| 2 | TRIGGER 7 | PURPLE | PURPLE | PURPLE | 3 | 3 | 3 | 27 | 12.26 |
| 2 | TRIGGER 8 | LIME | LIME | LIME | 4 | 3 | 2 | 24 | 12.26 |
| 2 | TRIGGER 9 | ROSE | ROSE | ROSE | 2 | 6 | 2 | 24 | 12.26 |
| 2 | TRIGGER 10 | TAN | TAN | TAN | 1 | 7 | 4 | 28 | 12.26 |
| 2 | TRIGGER 11 | PINK | PINK | PINK | 2 | 1 | 5 | 10 | 12.26 |
| 2 | TRIGGER 12 | BR. ORANGE | BR. ORANGE | BR. ORANGE | 2 | 5 | 2 | 20 | 12.26 |
| 2 | TRIGGER 13 | DK. YELLOW | DK. YELLOW | DK. YELLOW | 3 | 4 | 1 | 12 | 12.26 |
| 2 | TRIGGER 14 | MAROON | MAROON | MAROON | 4 | 2 | 1 | 8 | 12.26 |
| 2 | TRIGGER 15 | DK. BLUE | DK. BLUE | DK. BLUE | 3 | 2 | 4 | 24 | 12.26 |
| 2 | TRIGGER 16 | SEA GREEN | SEA GREEN | SEA GREEN | 2 | 4 | 3 | 24 | 12.26 |
| 2 | TRIGGER 17 | BR. GREEN | BR. GREEN | BR. GREEN | 2 | 2 | 5 | 20 | 12.26 |
| 2 | TRIGGER 18 | TEAL | TEAL | TEAL | 5 | 1 | 5 | 25 | 12.26 |
| 2 | TRIGGER 19 | PALE BLUE | PALE BLUE | PALE BLUE | 2 | 5 | 2 | 20 | 12.26 |
| 2 | TRIGGER 20 | WHITE | WHITE | WHITE | 3 | 2 | 4 | 24 | 12.26 |
| 2 | TRIGGER 21 | GREY | GREY | GREY | 3 | 3 | 2 | 18 | 12.26 |
| 2 | TRIGGER 22 | AQUA | AQUA | AQUA | 3 | 2 | 3 | 18 | 12.26 |
| | | COLOR OVERLAY, LINE 1-7. | | | 64 | 64 | 64 | 433 | |

| PAY | | COMBINATION REEL 3 | REEL 3 | REEL 3 | COLOR OVERLAY DISTRIBUTION OF PAYS REEL 3 | REEL 3 | REEL 3 | HITS | PAY |
|---|---|---|---|---|---|---|---|---|---|
| 2 | TRIGGER 1 | RED | RED | RED | 3 | 3 | 3 | 27 | 9.92 |
| 2 | TRIGGER 2 | GOLD | GOLD | GOLD | 3 | 3 | 3 | 27 | 9.92 |
| 2 | TRIGGER 3 | BLUE | BLUE | BLUE | 3 | 3 | 3 | 27 | 9.92 |
| 2 | TRIGGER 4 | YELLOW | YELLOW | YELLOW | 4 | 4 | 4 | 64 | 9.92 |
| 2 | TRIGGER 5 | ORANGE | ORANGE | ORANGE | 2 | 2 | 2 | 8 | 9.92 |
| 2 | TRIGGER 6 | LT. GREEN | LT. GREEN | LT. GREEN | 1 | 1 | 1 | 1 | 9.92 |
| 2 | TRIGGER 7 | PURPLE | PURPLE | PURPLE | 3 | 3 | 3 | 27 | 9.92 |
| 2 | TRIGGER 8 | LIME | LIME | LIME | 2 | 2 | 2 | 8 | 9.92 |
| 2 | TRIGGER 9 | ROSE | ROSE | ROSE | 2 | 2 | 2 | 8 | 9.92 |
| 2 | TRIGGER 10 | TAN | TAN | TAN | 4 | 4 | 4 | 64 | 9.92 |
| 2 | TRIGGER 11 | PINK | PINK | PINK | 5 | 5 | 5 | 125 | 9.92 |
| 2 | TRIGGER 12 | BR. ORANGE | BR. ORANGE | BR. ORANGE | 2 | 2 | 2 | 8 | 9.92 |
| 2 | TRIGGER 13 | DK. YELLOW | DK. YELLOW | DK. YELLOW | 1 | 1 | 1 | 1 | 9.92 |
| 2 | TRIGGER 14 | MAROON | MAROON | MAROON | 1 | 1 | 1 | 1 | 9.92 |
| 2 | TRIGGER 15 | DK. BLUE | DK. BLUE | DK. BLUE | 4 | 4 | 4 | 64 | 9.92 |
| 2 | TRIGGER 16 | SEA GREEN | SEA GREEN | SEA GREEN | 3 | 3 | 3 | 27 | 9.92 |
| 2 | TRIGGER 17 | BR. GREEN | BR. GREEN | BR. GREEN | 5 | 5 | 5 | 125 | 9.92 |
| 2 | TRIGGER 18 | TEAL | TEAL | TEAL | 5 | 5 | 5 | 125 | 9.92 |
| 2 | TRIGGER 19 | PALE BLUE | PALE BLUE | PALE BLUE | 2 | 2 | 2 | 8 | 9.92 |
| 2 | TRIGGER 20 | WHITE | WHITE | WHITE | 4 | 4 | 4 | 64 | 9.92 |
| 2 | TRIGGER 21 | GREY | GREY | GREY | 2 | 2 | 2 | 8 | 9.92 |
| 2 | TRIGGER 22 | AQUA | AQUA | AQUA | 3 | 3 | 3 | 27 | 9.92 |
| | | COLOR OVERLAY, LINE 8. | | | 64 | 64 | 64 | 844 | |

*FIG. 13*

LINE 1

| | # GAMES | H.F. | WIN/TRIG | WIN/TOTAL | % |
|---|---|---|---|---|---|
| RED | 7 | 13.03% | 11.18 | 301.87 | 0.12% |
| GOLD | 7 | 13.03% | 11.18 | 201.25 | 0.08% |
| BLUE | 7 | 13.03% | 11.18 | 268.33 | 0.10% |
| YELLOW | 7 | 13.03% | 11.18 | 223.61 | 0.09% |
| ORANGE | 7 | 13.03% | 11.18 | 178.89 | 0.07% |
| LT. GREEN | 17 | 13.03% | 27.15 | 54.50 | 0.02% |
| PURPLE | 7 | 13.03% | 11.18 | 301.87 | 0.12% |
| LIME | 7 | 13.03% | 11.18 | 268.33 | 0.10% |
| ROSE | 7 | 13.03% | 11.18 | 268.33 | 0.10% |
| TAN | 7 | 13.03% | 11.18 | 313.05 | 0.12% |
| PINK | 7 | 13.03% | 11.18 | 111.80 | 0.04% |
| BR. ORANGE | 7 | 13.03% | 11.18 | 223.61 | 0.09% |
| DK. YELLOW | 7 | 13.03% | 11.18 | 134.16 | 0.05% |
| MAROON | 14 | 13.03% | 22.36 | 178.89 | 0.07% |
| DK. BLUE | 7 | 13.03% | 11.18 | 268.33 | 0.10% |
| SEA GREEN | 7 | 13.03% | 11.18 | 268.33 | 0.10% |
| BR. GREEN | 7 | 13.03% | 11.18 | 223.61 | 0.09% |
| TEAL | 7 | 13.03% | 11.18 | 279.51 | 0.11% |
| PALE BLUE | 7 | 13.03% | 11.18 | 223.61 | 0.09% |
| WHITE | 7 | 13.03% | 11.18 | 268.33 | 0.10% |
| GREY | 7 | 13.03% | 11.18 | 201.25 | 0.08% |
| AQUA | 7 | 13.03% | 11.18 | 201.25 | 0.08% |
| | 88.000% | | | | |

HITS 203.28 HOT M 1-7 1.89%
GAMES 1659.14 LINE 1-7 79.86%
TOTAL 11849.66 ANY 7,8,9 3.89%
3+STAR 2.36%
LINE 1 GAME 88.000%

LINE 2

| | # GAMES | H.F. | WIN/TRIG | WIN/TOTAL | % |
|---|---|---|---|---|---|
| RED | 14 | 13.03% | 22.36 | 603.74 | 0.23% |
| GOLD | 14 | 13.03% | 22.36 | 402.49 | 0.15% |
| BLUE | 14 | 13.03% | 22.36 | 536.66 | 0.20% |
| YELLOW | 14 | 13.03% | 22.36 | 447.21 | 0.17% |
| ORANGE | 14 | 13.03% | 22.36 | 357.77 | 0.14% |
| LT. GREEN | 58 | 13.03% | 92.64 | 185.27 | 0.07% |
| PURPLE | 14 | 13.03% | 22.36 | 603.74 | 0.23% |
| LIME | 14 | 13.03% | 22.36 | 536.66 | 0.20% |
| ROSE | 14 | 13.03% | 22.36 | 536.66 | 0.20% |
| TAN | 14 | 13.03% | 22.36 | 626.10 | 0.24% |
| PINK | 14 | 13.03% | 22.36 | 223.61 | 0.09% |
| BR. ORANGE | 14 | 13.03% | 22.36 | 447.21 | 0.17% |
| DK. YELLOW | 14 | 13.03% | 22.36 | 268.33 | 0.10% |
| MAROON | 44 | 13.03% | 70.28 | 562.21 | 0.21% |
| DK. BLUE | 14 | 13.03% | 22.36 | 536.66 | 0.20% |
| SEA GREEN | 14 | 13.03% | 22.36 | 536.66 | 0.20% |
| BR. GREEN | 14 | 13.03% | 22.36 | 447.21 | 0.17% |
| TEAL | 14 | 13.03% | 22.36 | 559.02 | 0.21% |
| PALE BLUE | 14 | 13.03% | 22.36 | 447.21 | 0.17% |
| WHITE | 14 | 13.03% | 22.36 | 536.66 | 0.20% |
| GREY | 14 | 13.03% | 22.36 | 402.49 | 0.15% |
| AQUA | 14 | 13.03% | 22.36 | 402.49 | 0.15% |
| | 89.000% | | | | |

HITS 412.81 HOT M 1-7 3.89%
GAMES 1659.14 LINE 1-7 79.86%
TOTAL 5059.91 ANY 7,8,9 3.89%
3+STAR 2.36%
LINE 2 GAME 89.000%

LINE 5

| | # GAMES | H.F. | WIN/TRIG | WIN/TOTAL | % |
|---|---|---|---|---|---|
| RED | 60 | 13.03% | 95.83 | 2587.45 | 0.99% |
| GOLD | 60 | 13.03% | 95.83 | 1724.97 | 0.66% |
| BLUE | 60 | 13.03% | 95.83 | 2299.96 | 0.88% |
| YELLOW | 60 | 13.03% | 95.83 | 1916.63 | 0.73% |
| ORANGE | 60 | 13.03% | 95.83 | 1533.31 | 0.58% |
| LT. GREEN | 112 | 13.03% | 178.89 | 357.77 | 0.14% |
| PURPLE | 60 | 13.03% | 95.83 | 2587.45 | 0.99% |
| LIME | 60 | 13.03% | 95.83 | 2299.96 | 0.88% |
| ROSE | 60 | 13.03% | 95.83 | 2299.96 | 0.88% |
| TAN | 60 | 13.03% | 95.83 | 2683.29 | 1.02% |
| PINK | 60 | 13.03% | 95.83 | 958.32 | 0.37% |
| BR. ORANGE | 60 | 13.03% | 95.83 | 1916.63 | 0.73% |
| DK. YELLOW | 60 | 13.03% | 95.83 | 1149.98 | 0.44% |
| MAROON | 60 | 13.03% | 95.83 | 766.65 | 0.29% |
| DK. BLUE | 60 | 13.03% | 95.83 | 2299.96 | 0.88% |
| SEA GREEN | 60 | 13.03% | 95.83 | 2299.96 | 0.88% |
| BR. GREEN | 60 | 13.03% | 95.83 | 1916.63 | 0.73% |
| TEAL | 60 | 13.03% | 95.83 | 2395.79 | 0.91% |
| PALE BLUE | 60 | 13.03% | 95.83 | 1916.63 | 0.73% |
| WHITE | 60 | 13.03% | 95.83 | 2299.96 | 0.88% |
| GREY | 60 | 13.03% | 95.83 | 1724.97 | 0.66% |
| AQUA | 60 | 13.03% | 95.83 | 1724.97 | 0.66% |
| | 92.000% | | | | |

HITS 3024.69 HOT M 1-7 15.89%
GAMES 605.41 LINE 1-7 79.86%
TOTAL 21249.07 ANY 7,8,9 3.89%
3+STAR 2.36%
LINE 5 GAME 92.000%

LINE 6

| | # GAMES | H.F. | WIN/TRIG | WIN/TOTAL | % |
|---|---|---|---|---|---|
| RED | 82 | 13.03% | 130.97 | 3536.19 | 1.35% |
| GOLD | 82 | 13.03% | 130.97 | 2357.46 | 0.90% |
| BLUE | 82 | 13.03% | 130.97 | 3143.28 | 1.20% |
| YELLOW | 82 | 13.03% | 130.97 | 2619.40 | 1.00% |
| ORANGE | 82 | 13.03% | 130.97 | 2095.52 | 0.80% |
| LT. GREEN | 127 | 13.03% | 202.84 | 405.69 | 0.15% |
| PURPLE | 82 | 13.03% | 130.97 | 3536.19 | 1.35% |
| LIME | 82 | 13.03% | 130.97 | 3143.28 | 1.20% |
| ROSE | 82 | 13.03% | 130.97 | 3143.28 | 1.20% |
| TAN | 82 | 13.03% | 130.97 | 3667.16 | 1.40% |
| PINK | 82 | 13.03% | 130.97 | 1309.70 | 0.50% |
| BR. ORANGE | 82 | 13.03% | 130.97 | 2619.40 | 1.00% |
| DK. YELLOW | 82 | 13.03% | 130.97 | 1571.64 | 0.60% |
| MAROON | 124 | 13.03% | 130.97 | 1584.42 | 0.60% |
| DK. BLUE | 82 | 13.03% | 130.97 | 3143.28 | 1.20% |
| SEA GREEN | 82 | 13.03% | 130.97 | 3143.28 | 1.20% |
| BR. GREEN | 82 | 13.03% | 130.97 | 2619.40 | 1.00% |
| TEAL | 82 | 13.03% | 130.97 | 3274.25 | 1.25% |
| PALE BLUE | 82 | 13.03% | 130.97 | 2619.40 | 1.00% |
| WHITE | 82 | 13.03% | 130.97 | 3143.28 | 1.20% |
| GREY | 82 | 13.03% | 130.97 | 2357.46 | 0.90% |
| AQUA | 82 | 13.03% | 130.97 | 2357.46 | 0.90% |
| | 93.000% | | | | |

HITS 4130.35 HOT M 1-7 21.89%
GAMES 605.41 LINE 1-7 79.86%
TOTAL 28957.13 ANY 7,8,9 3.89%
3+STAR 2.36%
LINE 6 GAME 93.000%

*FIG. 14*

LINE 3

| | GAMES | H.F. | WIN/TRIG | WIN/TOTAL | % |
|---|---|---|---|---|---|
| RED | 26 | 13.03% | 41.53 | 1121.23 | 0.43% |
| GOLD | 26 | 13.03% | 41.53 | 747.49 | 0.29% |
| BLUE | 26 | 13.03% | 41.53 | 996.65 | 0.38% |
| YELLOW | 26 | 13.03% | 41.53 | 830.54 | 0.32% |
| ORANGE | 26 | 13.03% | 41.53 | 664.43 | 0.25% |
| LT GREEN | 53 | 13.03% | 84.65 | 169.30 | 0.06% |
| PURPLE | 26 | 13.03% | 41.53 | 1121.23 | 0.43% |
| LIME | 26 | 13.03% | 41.53 | 996.65 | 0.38% |
| ROSE | 26 | 13.03% | 41.53 | 996.65 | 0.38% |
| TAN | 26 | 13.03% | 41.53 | 1162.76 | 0.44% |
| THINK! | 26 | 13.03% | 41.53 | 415.27 | 0.16% |
| BR ORANGE | 26 | 13.03% | 41.53 | 830.54 | 0.32% |
| DK YELLOW | 26 | 13.03% | 41.53 | 498.32 | 0.19% |
| MAROON | 26 | 13.03% | 41.53 | 332.22 | 0.13% |
| DK BLUE | 26 | 13.03% | 41.53 | 996.65 | 0.38% |
| SEA GREEN | 26 | 13.03% | 41.53 | 996.65 | 0.38% |
| BR GREEN | 26 | 13.03% | 41.53 | 830.54 | 0.32% |
| TEAL | 26 | 13.03% | 41.53 | 1038.18 | 0.40% |
| PALE BLUE | 26 | 13.03% | 41.53 | 830.54 | 0.32% |
| WHITE | 26 | 13.03% | 41.53 | 996.65 | 0.38% |
| GREY | 26 | 13.03% | 41.53 | 747.49 | 0.29% |
| AQUA | 26 | 13.03% | 41.53 | 747.49 | 0.29% |

90.000%

HITS 752.39 HOT M 1-7 6.89%
GAMES 1659.14 LINE 1-7 79.86%
TOTAL 9222.20 ANY 7,8,9 3.89%
3+STAR 2.36%
LINE 3 GAME 90.000%

LINE 4

| | GAMES | H.F. | WIN/TRIG | WIN/TOTAL | % |
|---|---|---|---|---|---|
| RED | 41 | 13.03% | 65.48 | 1738.09 | 0.67% |
| GOLD | 41 | 13.03% | 65.48 | 1178.73 | 0.45% |
| BLUE | 41 | 13.03% | 65.48 | 1571.64 | 0.60% |
| YELLOW | 41 | 13.03% | 65.48 | 1309.70 | 0.50% |
| ORANGE | 41 | 13.03% | 65.48 | 1047.76 | 0.40% |
| LT GREEN | 103 | 13.03% | 164.51 | 329.02 | 0.13% |
| PURPLE | 41 | 13.03% | 65.48 | 1768.09 | 0.67% |
| LIME | 41 | 13.03% | 65.48 | 1571.64 | 0.60% |
| ROSE | 41 | 13.03% | 65.48 | 1571.64 | 0.60% |
| TAN | 41 | 13.03% | 65.48 | 1833.58 | 0.70% |
| THINK! | 41 | 13.03% | 65.48 | 654.85 | 0.25% |
| BR ORANGE | 41 | 13.03% | 65.48 | 1309.70 | 0.50% |
| DK YELLOW | 41 | 13.03% | 65.48 | 785.82 | 0.30% |
| MAROON | 41 | 13.03% | 65.48 | 523.88 | 0.20% |
| DK BLUE | 41 | 13.03% | 65.48 | 1571.64 | 0.60% |
| SEA GREEN | 41 | 13.03% | 65.48 | 1571.64 | 0.60% |
| BR GREEN | 41 | 13.03% | 65.48 | 1309.70 | 0.50% |
| TEAL | 41 | 13.03% | 65.48 | 1637.12 | 0.62% |
| PALE BLUE | 41 | 13.03% | 65.48 | 1309.70 | 0.50% |
| WHITE | 41 | 13.03% | 65.48 | 1571.64 | 0.60% |
| GREY | 41 | 13.03% | 65.48 | 1178.73 | 0.45% |
| AQUA | 41 | 13.03% | 65.48 | 1178.73 | 0.45% |

91.000%

HITS 1191.53 HOT M 1-7 10.89%
GAMES 1659.14 LINE 1-7 79.86%
TOTAL 14604.75 ANY 7,8,9 3.89%
3+STAR 2.36%
LINE 4 GAME 91.000%

LINE 7

| | GAMES | H.F. | WIN/TRIG | WIN/TOTAL | % |
|---|---|---|---|---|---|
| RED | 109 | 13.03% | 174.09 | 4700.54 | 1.79% |
| GOLD | 109 | 13.03% | 174.09 | 3133.70 | 1.20% |
| BLUE | 109 | 13.03% | 174.09 | 4178.26 | 1.59% |
| YELLOW | 109 | 13.03% | 174.09 | 3481.88 | 1.33% |
| ORANGE | 109 | 13.03% | 174.09 | 2785.51 | 1.06% |
| LT GREEN | 137 | 13.03% | 218.82 | 437.63 | 0.17% |
| PURPLE | 109 | 13.03% | 174.09 | 4700.54 | 1.79% |
| LIME | 109 | 13.03% | 174.09 | 4178.26 | 1.59% |
| ROSE | 109 | 13.03% | 174.09 | 4178.26 | 1.59% |
| TAN | 109 | 13.03% | 174.09 | 4874.64 | 1.86% |
| THINK! | 109 | 13.03% | 174.09 | 1740.94 | 0.66% |
| BR ORANGE | 109 | 13.03% | 174.09 | 3481.88 | 1.33% |
| DK YELLOW | 109 | 13.03% | 174.09 | 2089.13 | 0.80% |
| MAROON | 130 | 13.03% | 207.64 | 1661.08 | 0.63% |
| DK BLUE | 109 | 13.03% | 174.09 | 4178.26 | 1.59% |
| SEA GREEN | 109 | 13.03% | 174.09 | 4178.26 | 1.59% |
| BR GREEN | 109 | 13.03% | 174.09 | 3481.88 | 1.33% |
| TEAL | 109 | 13.03% | 174.09 | 4352.35 | 1.66% |
| PALE BLUE | 109 | 13.03% | 174.09 | 3481.88 | 1.33% |
| WHITE | 109 | 13.03% | 174.09 | 4178.26 | 1.59% |
| GREY | 109 | 13.03% | 174.09 | 3133.70 | 1.20% |
| AQUA | 109 | 13.03% | 174.09 | 3133.70 | 1.20% |

94.000%

HITS 5486.19 HOT M 1-7 28.89%
GAMES 605.41 LINE 1-7 79.86%
TOTAL 38390.16 ANY 7,8,9 3.89%
3+STAR 2.36%
LINE 7 GAME 94.000%

LINE 8

| | GAMES | H.F. | WIN/TRIG | WIN/TOTAL | % |
|---|---|---|---|---|---|
| RED | 69 | 16.30% | 111.57 | 3012.34 | 1.15% |
| GOLD | 69 | 16.30% | 111.57 | 3012.34 | 1.15% |
| BLUE | 69 | 16.30% | 111.57 | 3012.34 | 1.15% |
| YELLOW | 69 | 16.30% | 111.57 | 7140.35 | 2.72% |
| ORANGE | 69 | 16.30% | 111.57 | 892.54 | 0.34% |
| LT GREEN | 69 | 16.30% | 111.57 | 111.57 | 0.04% |
| PURPLE | 69 | 16.30% | 111.57 | 3012.34 | 1.15% |
| LIME | 69 | 16.30% | 111.57 | 892.54 | 0.34% |
| ROSE | 69 | 16.30% | 111.57 | 892.54 | 0.34% |
| TAN | 69 | 16.30% | 111.57 | 7140.35 | 2.72% |
| THINK! | 69 | 16.30% | 111.57 | 13946.00 | 5.32% |
| BR ORANGE | 69 | 16.30% | 111.57 | 892.54 | 0.34% |
| DK YELLOW | 69 | 16.30% | 111.57 | 111.57 | 0.04% |
| MAROON | 69 | 16.30% | 111.57 | 111.57 | 0.04% |
| DK BLUE | 69 | 16.30% | 111.57 | 7140.35 | 2.72% |
| SEA GREEN | 69 | 16.30% | 111.57 | 3012.34 | 1.15% |
| BR GREEN | 69 | 16.30% | 111.57 | 13946.00 | 5.32% |
| TEAL | 69 | 16.30% | 111.57 | 13946.00 | 5.32% |
| PALE BLUE | 69 | 16.30% | 111.57 | 892.54 | 0.34% |
| WHITE | 69 | 16.30% | 111.57 | 7140.35 | 2.72% |
| GREY | 69 | 16.30% | 111.57 | 892.54 | 0.34% |
| AQUA | 69 | 16.30% | 111.57 | 3012.34 | 1.15% |

95.002% 43065.26

HITS 3470.60 HOT M 8 35.92%
GAMES 310.60 LINE 8 80.85%
ANY 7,8,9 3.89%
3+STAR 2.36%
LINE 8 GAME 95.002%

FIG. 15

LINE 8

| | # GAMES | H.F. | WIN/TRIG | WIN/TOTAL | % |
|---|---|---|---|---|---|
| RED | 105 | 16.03% | 169.78 | 4583.99 | 1.75% |
| GOLD | 105 | 16.03% | 169.78 | 4583.99 | 1.75% |
| BLUE | 105 | 16.03% | 169.78 | 4583.99 | 1.75% |
| YELLOW | 105 | 16.03% | 169.78 | 10865.76 | 4.14% |
| ORANGE | 105 | 16.03% | 169.78 | 1358.22 | 0.52% |
| LT GREEN | 465 | 16.03% | 751.87 | 751.87 | 0.29% |
| PURPLE | 105 | 16.03% | 169.78 | 4583.99 | 1.75% |
| LIME | 105 | 16.03% | 169.78 | 1358.22 | 0.52% |
| ROSE | 105 | 16.03% | 169.78 | 1358.22 | 0.52% |
| TAN | 105 | 16.03% | 169.78 | 10865.76 | 4.14% |
| PINK | 105 | 16.03% | 169.78 | 21222.18 | 8.10% |
| BR ORANGE | 105 | 16.03% | 169.78 | 1358.22 | 0.52% |
| DK YELLOW | 105 | 16.03% | 169.78 | 169.78 | 0.06% |
| MAROON | 465 | 16.03% | 751.87 | 751.87 | 0.29% |
| DK BLUE | 105 | 16.03% | 169.78 | 10865.76 | 4.14% |
| SEA GREEN | 105 | 16.03% | 169.78 | 4583.99 | 1.75% |
| BR GREEN | 105 | 16.03% | 169.78 | 21222.18 | 8.10% |
| TEAL | 105 | 16.03% | 169.78 | 21222.18 | 8.10% |
| PALE BLUE | 105 | 16.03% | 169.78 | 1358.22 | 0.52% |
| WHITE | 105 | 16.03% | 169.78 | 10865.76 | 4.14% |
| GREY | 105 | 16.03% | 169.78 | 1358.22 | 0.52% |
| AQUA | 105 | 16.03% | 169.78 | 4583.99 | 1.75% |
| | | 97.400% | | 66116.19 | |

| | | | |
|---|---|---|---|
| HITS | 5328.26 | HOT M 8 | 55.11% |
| GAMES | 310.60 | LINE 8 | 80.85% |
| | | ANY 7,8,9 | 3.89% |
| | | 3+STAR | 2.36% |
| | LINE 8 | GAME | 97.400% |

*FIG. 16*

TABLE 4

| COMBINATION | | | ON PAY LINE |
|---|---|---|---|
| BLUE 7 | BLUE 7 | BLUE 7 | 500 |
| FRUIT 7 | FRUIT 7 | FRUIT 7 | 100 |
| WILD BAR | WILD BAR | WILD BAR | 50 |
| STAR | STAR | STAR | 50 |
| ANY 7 | ANY 7 | ANY 7 | 50 |
| 3 BAR | 3 BAR | 3 BAR | 40 |
| TARGET | TARGET | TARGET | 40 |
| BELL | BELL | BELL | 20 |
| 2 BAR | 2 BAR | 2 BAR | 20 |
| PLUM | PLUM | PLUM | 10 |
| 1 BAR | 1 BAR | 1 BAR | 10 |
| CHERRY | CHERRY | CHERRY | 10 |
| ANY BAR | ANY BAR | ANY BAR | 5 |
| ORANGE | ORANGE | ORANGE | 5 |
| ANY 2' CHERRIES | | | 5 |
| 3 SAME COLOR OVERLAY | | | 5 |
| ANY 1' CHERRY | | | 2 |

PAYS MULTIPLIES BY COINS BET

| | | | | | |
|---|---|---|---|---|---|
| (9) | STAR | 1000 | (8) | STAR | 800 |
| (9) | FRUIT 7 | 1000 | (8) | FRUIT 7 | 200 |
| (9) | BLUE 7 | 1000 | (8) | BLUE 7 | 1000 |
| (9) | ANY 7 | 1000 | (8) | ANY 7 | 100 |
| (9) | BELL | 400 | (8) | BELL | 40 |
| (9) | PLUM | 200 | (8) | PLUM | 20 |
| (9) | ORANGE | 100 | (8) | ORANGE | 10 |
| (9) | CHERRY | 100 | (8) | CHERRY | 20 |
| (9) | TARGET | 400 | (8) | TARGET | 80 |
| (9) | WILD BAR | 500 | (8) | WILD BAR | 100 |
| (9) | 3 BAR | 400 | (8) | 3 BAR | 80 |
| (9) | 2 BAR | 200 | (8) | 2 BAR | 40 |
| (9) | 1 BAR | 100 | (8) | 1 BAR | 20 |
| (9) | ANY BAR | 10 | (8) | ANY BAR | 5 |
| (7) | STAR | 400 | (3) | STAR | |
| (7) | FRUIT 7 | 100 | (4) | STAR | |
| (7) | BLUE 7 | 500 | (5) | STAR | |
| (7) | ANY 7 | 50 | (6) | STAR | |
| (7) | BELL | 20 | | | |
| (7) | PLUM | 10 | | | |
| (7) | ORANGE | 5 | | | |
| (7) | CHERRY | 10 | | | |
| (7) | TARGET | 40 | | | |
| (7) | WILD BAR | 50 | | | |
| (7) | 3 BAR | 40 | | | |
| (7) | 2 BAR | 20 | | | |
| (7) | 1 BAR | 10 | | | |
| (7) | ANY BAR | 2 | | | |

TABLE 5

TABLE 6

| COMBINATION | | | ON PAY LINE |
|---|---|---|---|
| BONUS | BONUS | BLUE 7 | 1000 |
| BONUS | BONUS | FRUIT 7 | 200 |
| BONUS | BONUS | WILD BAR | 100 |
| BONUS | BONUS | STAR | 100 |
| BONUS | BONUS | 3 BAR | 80 |
| BONUS | BONUS | TARGET | 80 |
| BONUS | BONUS | BELL | 40 |
| BONUS | BONUS | 2 BAR | 40 |
| BONUS | BONUS | PLUM | 20 |
| BONUS | BONUS | 1 BAR | 20 |
| BONUS | BONUS | CHERRY | 20 |
| BONUS | BONUS | ORANGE | 10 |

TABLE 7 ON PAY LINE 8

| | | |
|---|---|---|
| ANY 2 BONUS SYMBOLS APPEARING ON ANY OF THE 9 REELS. PAYS THE AMOUNT OF THE SYMBOL OF THE LINES PLAYED. THE PAY SYMBOL IS LOCATED ON LINE 8, OR ON BONUS CIRCLE. | BLUE 7 | 500 |
| | FRUIT 7 | 100 |
| | WILD BAR | 50 |
| | STAR | 50 |
| | 3 BAR | 40 |
| | TARGET | 40 |
| | BELL | 20 |
| | 2 BAR | 20 |
| | PLUM | 10 |
| | 1 BAR | 10 |
| | CHERRY | 10 |
| | ORANGE | 5 |

TABLE 8 ON PAY LINE 8

| | | |
|---|---|---|
| ANY 3 OR MORE BONUS SYMBOLS APPEARING ON ANY OF THE 9 REELS. PAYS THE AMOUNT OF THE SYMBOL OF THE LINES PLAYED. THE PAY SYMBOL IS LOCATED ON LINE 8, OR ON BONUS CIRCLE. | BLUE 7 | 1000 |
| | FRUIT 7 | 200 |
| | WILD BAR | 100 |
| | STAR | 100 |
| | 3 BAR | 80 |
| | TARGET | 80 |
| | BELL | 40 |
| | 2 BAR | 40 |
| | PLUM | 20 |
| | 1 BAR | 20 |
| | CHERRY | 20 |
| | ORANGE | 10 |

FIG. 17

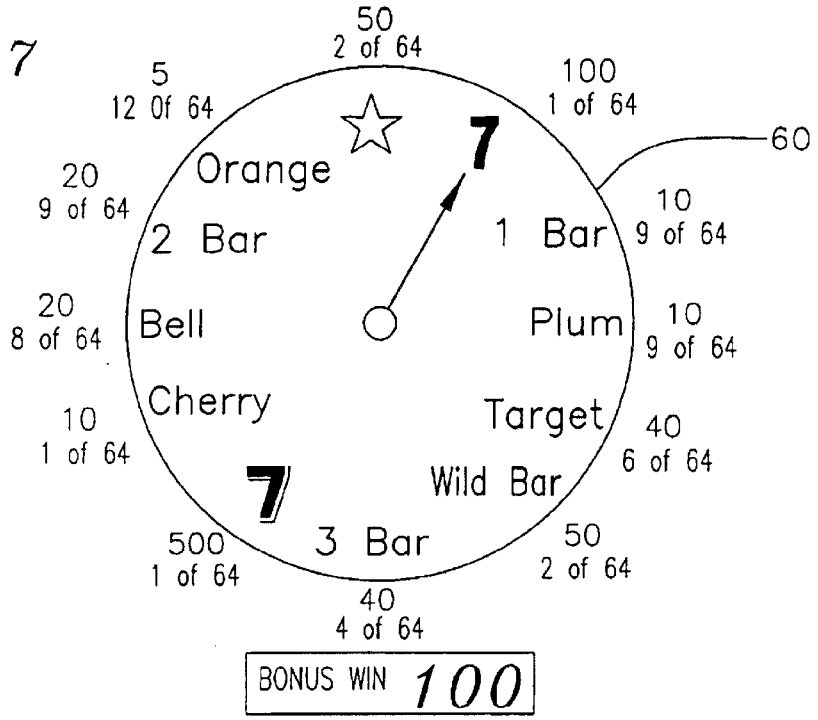

SECOND SCREEN , WHENEVER 2 BONUS SYMBOLS APPEAR ON THE 9 REEL GAME, THE PLAYER RECEIVES A BONUS SPIN FOR EACH OF THE COINS BET ON LINE 1 THROUGH 8. IF THE MACHINE IS IN A HOT STREAK FOR A SPECIFIC LINE, THEN, THAT BONUS CIRCLE PAYS DOUBLE. IF 2 BONUSES ARE ON A SPECIFIC LINE, THAT BONUS CIRCLE WILL PAY DOUBLE, (4 X IF THAT LINE IS IN HOT STREAK). ONLY 6 BONUS CIRCLES ARE DISPLAYED. SO 2 OF THE LINES ARE DISPLAYED ON THE 5TH AND 6TH BONUS CIRCLES AS DOUBLE. IF THOSE CIRCLES ARE ALREADY DOUBLED BECAUSE OF HOT STREAK, OR 2 BONUSES ON THE LINE, THEN THE 4TH BONUS CIRCLE IS DOUBLED, AND SO ON. FOR EACH OF THE COINS BET ON LINE 1 THROUGH 7, AND 3 OR MORE BONUS SYMBOLS APPEAR, THE PLAYER RECEIVES 2 BONUS CIRCLES FOR EACH COIN PLAYED. HOT STREAK, AND BONUSES ON A LINE APPLY FOR 2 BONUS CIRCLES. 12 TOTAL, IF 8 COINS WERE PLAYED.

| PAY | SYMBOL | ODDS/64 |
|---|---|---|
| 50 | STAR | 2 |
| 500 | BLUE 7 | 1 |
| 50 | WILD BAR | 2 |
| 50 | 3 BAR | 4 |
| 20 | 2 BAR | 9 |
| 10 | 1 BAR | 9 |
| 10 | CHERRY | 1 |
| 100 | FRUIT 7 | 1 |
| 5 | ORANGE | 12 |
| 10 | PLUM | 9 |
| 20 | BELL | 8 |
| 40 | TARGET | 6 |
| | | 64 |

RANDOM 7 COIN PAY
228.75 THEORETICAL 7 COIN PAY.
28.59 THEORETICAL PAY PER COIN PLAYED.

*FIG. 18*
8 COIN BONUS: 4 MATCHING SYMBOLS, SIDES OR CORNERS RESPINS CENTER REEL
IF THE RESPIN RESULTS IN AN ANY 7,8,9 COMBINATION, THE WIN IS 2 X THE 1 COIN ANY 7,8,9 PAY SCHEDULE.
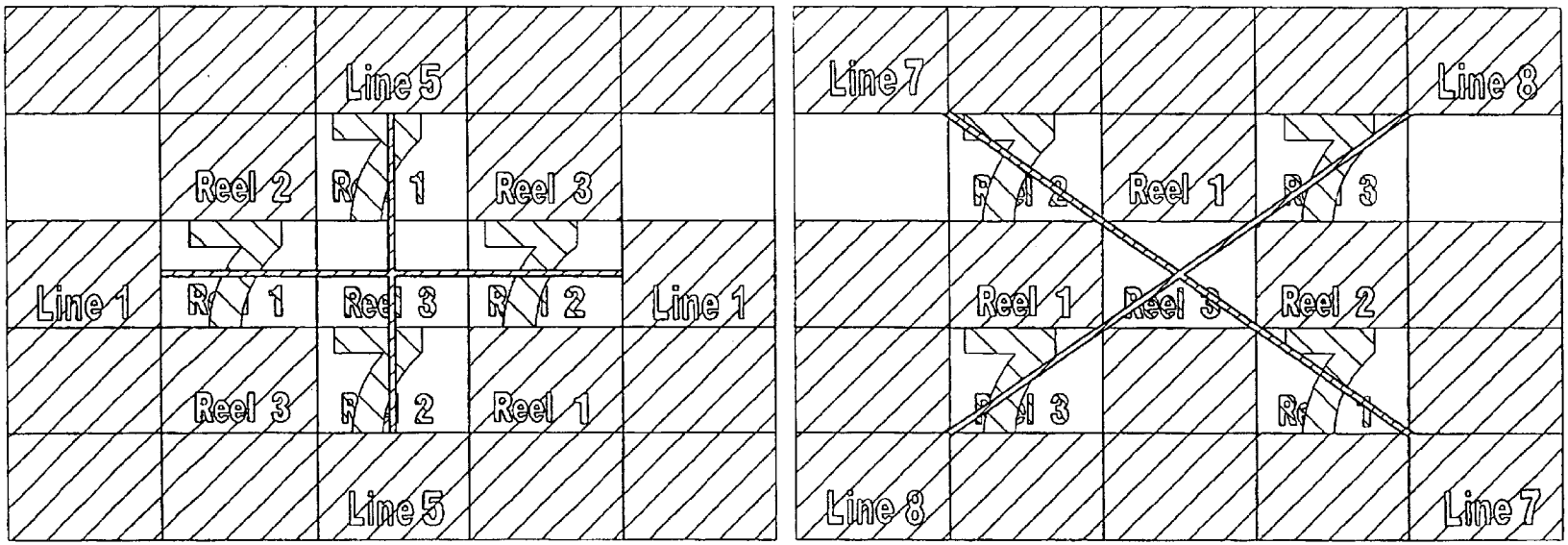
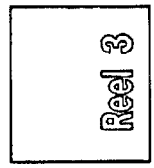
RESPIN CENTER REEL

DEVICE AND METHOD FOR CONFIGURING A SLOT MACHINE HAVING A HOT STREAK PHASE

CROSS-REFERENCE TO RELATED APPLICATIONS

The present utility application claims the priority of U.S. Provisional Application Ser. No. 60/244,431 filed Oct. 30, 2000 now abandoned, titled "Device and Method for a Multi-reel Slot Machine and Game" and U.S. Provisional Application Ser. No. 60/268,838 filed Feb. 14, 2001 now abandoned, titled "Device and Method for a Slot Machine Having a Hot Streak Phase".

FIELD OF THE INVENTION

The present invention relates to slot machines and video Poker games.

BACKGROUND

Three reel, four-reel and five-reel slot machines are well known. In certain embodiments, the machines are electro-mechanical in nature using mechanical reels and a processor to control the selection of symbols and rotation of the reels. More recently, machines have used a video display which displays representations of reels and the indicia thereon.

In regards to the electro-mechanical machines, each reel has about its perimeter a strip bearing the symbols (including any blanks) for the reel. The reels are spun and stop each presenting indicia at one or more pay lines. As can be appreciated, the arrangement of the indicia on each reel strip is in a fixed, predetermined, order. Thus, for example, if a strip has at adjacent positions on the strip indicia of "7, Blank, Bar", if the reel stops with the "Blank" at the pay line, the "7" will be displayed on the reel in a position above the "Blank" and the "Bar" displayed below the "Blank".

Modernly it has become known to use a processor including means for randomly selecting an outcome, these means often referred to as a random number generator. As described in Telnaes, U.S. Pat. No. 4,448,419 issued May 15, 1984, multiple symbols/blanks are provided and stored in a data structure and, when a map address(es) is/are selected by the processor the processor controls the reels to stop and display the selected symbol(s) appearing on the reel strip. That is, while the reel strip may have only 6 blanks, the processor may "see" 20 blanks in the map of addresses. If one of the virtual 20 blanks is selected, it is mapped to a blank on the reel strip for display. The data at the selected address is used to control the reels to stop and display the map address dictated outcome. Since mechanical reels are used to display the outcome, the indicia for each reel are still arranged in a predetermined, fixed, order. However, since mapping is used as opposed to being constrained by the physical layout of the mechanical reels, probabilities for any outcome can be adjusted simply by adjusting the map. Further, in regards to the mapping approach, adjacent map addresses do not match the physical reel strips on the reels. That is, the map has a plurality of addresses, e.g. 64 addresses, each corresponding to a game symbol (or blank). When the processor picks an address, for example, address number 32 which is a "bar", the processor controls the electromechanical device for reel 1 to find and stop at a "bar". The symbols adjacent to the displayed "bar" on the physical reel are ignored by the map and processor. Thus the map does not correspond to the physical layout of the reels. Thus the statistical methodology for determining the probabilities of outcomes for the mechanical reels cannot be used to determine hit frequencies for the game.

It would be advantageous to have adjacent map addresses correspond to those on the physical reel strip. That is, if on the physical reel strip for a reel adjacent symbols are:

Blank

BAR

BAR—BAR the map has the following clustering of symbols at addresses:

| Address | Symbol |
|---|---|
| N + 1 | Blank |
| N | BAR |
| N − 1 | BAR-BAR |

Thus the processor would select the cluster by randomly selecting N. The processor would take the data for N, N+1 and N−1 and control the reel to stop and display the appropriate, corresponding cluster on the reel strip. In this fashion the map would directly correspond to the physical reel strip. By repeating clusters in the map, 64 or any number of virtual stops can be arranged in the map to represent the clustering of symbols for 22 actual reel stops. In this fashion the symbol distribution on the reels and the maps would match and by selecting and duplicating clusters in the map, the calculation of hit frequencies for outcomes would correspond to the physical layout of the reels. Any objections or complaints that mapping does not correspond to the physical layout of the reels would be alleviated.

In regards to stepper games, each game has a predetermined hit frequency for each outcome including winning outcomes. A hit frequency is the statistical frequency, in a percentage, that each outcome will occur. These hit frequencies are calculated based upon the number of stops for the reel (or mapped stops) and the distribution of symbols. Knowing winning outcome symbol combinations, the number of stops and symbol distribution, the frequency each winning combination will statistically occur can be calculated. By assigning a pay to each winning combination the overall hold (wagers in-awards issued) can be determined. In regards to deriving a hold for a game, the general approaches are to provide infrequent winning combinations with higher pays or more frequent wins with lower pays. Since many players prefer games with higher pays, e.g. jackpots, they tend to play games which exhibit infrequent wins or "hits". Infrequent wins induces frustration and the player will often abandoned the machine and not play it again.

It would be advantageous to provide a game and method where a base game is configured to have predetermined hit frequencies and where means are provided to, for at least for a number of games, multiply certain winning combinations to enhance the award and to use the base game and games with a multiplier to configure the overall hold of the game to the desired level.

Each reel stop position would serve a multiple purpose. It wold represent a symbol for the base game and would act, by itself or in combination with symbols on other reels to trigger a secondary game feature. This secondary feature could be a multiplier that would increase the awards for winning, base game, combinations for a predetermined number of future games.

It would alternatively be advantageous to provide, for a predetermined number of games, a modified pay table of winning combinations to increase, for those games, an enhanced hit frequency. For example, for a limited number of games, any symbol on a selected reel may be a winning combination and entitled to an award based upon a special pay table. By configuring the base game, triggers, winning pays, the limited feature can be used to configure the overall game to the desired hold. Further, providing a game where consecutive wins occur, would attract players to the game.

Video slot machines are also well known. In these machines, instead of using physical, mechanical reels, a video display is controlled to display simulated reels and outcomes. It would be advantageous to provide the features mentioned above to these types of games as well.

In regards to slot machines, it has been known to provide a default, virtual symbol inventory, e.g. map and a bonus symbol inventory. In Weiss, U.S. Pat. No. 5,833,538 there is described a game where a trigger invokes a second symbol distribution or map making certain outcomes, statistically, more probable than in the default inventory. Thus, this game uses the same pay or award schedule but makes, during a bonus phase, one or more outcomes more likely than with the default pay table. This it does by adding symbols, changing the distribution of symbols in the map inventory.

A drawback of this approach is that the game merely increases the player's chances for obtaining a winning outcome. The player, during the Weiss incentive or bonus mode, may still not obtain a winning outcome while the mode is invoked.

There is a need for slot machines to provide a different approach to mapping to provide a game where the map matches the symbol distribution and, for mechanical reels, the physical reel layout. There is also a need for game which provides for a hot streak phase where losing symbols or symbol combinations are winning combinations to provide more and consecutive winning outcomes, or a winning outcome for each of a predetermined number of succeeding games and/or where, for a predetermined number of games, awards are multiplied.

Another type of slot machine which is popular is video Poker. In video Poker, a data structure is provided which stored data representing each card of a deck of fifty-two cards (fifty-three cards if the game includes a Joker). When a wager is made and play prompted, five cards are selected and displayed at a video display. The player holds none, some or all of the cards. The cards which are not held are replaced with cards selected from the data structure to produce a five card, final hand. The final hand is compared to a schedule of winning hands, typically based upon the rankings of Poker hands, and if a winning hand has been obtained the player is paid according to the schedule.

For Video Poker, it is known to provide progressively increasing pay outs for certain winning card combinations based upon contributions from Video Poker machines, i.e. progressive jackpots. It is also known to provide, based upon a triggering outcome, to re-configure the pay table such as providing an enhanced pay for a certain outcome such as flushes. However, I am not aware of any such game where losing outcomes, over a number of games, are re-designated as winning outcomes or where, for a period of games, enhanced pays are provided for all winning outcomes. Further, in regards to Video Poker, it would be advantageous to provide a hot streak phase where additional cards are added to the data structure, e.g. adding to a standard deck an additional Ace —10 for each suit (20 cards), a virtual deck of 72 cards thus making certain combinations such as a Royal Flush more likely or for example, maintain the pay schedule, maintain the 52 or 53 card deck, and add additional features for a limited time. The Deuces can be wild, thus increasing the likelihood of winning combinations for the specific pay schedule.

For both Slot machines and Video Poker machines there is a need for a device and method whereby the pay (or conversely hold) of the machine can be altered to any desired level by including and configuring a hot streak phase. Further in this regard there is a need for providing a game where, during a hot streak phase, the player will have more winning outcomes and pays and where the phase is displayed to entice the player to continue play as well as entice other players to play the game.

Another game that could be greatly enhanced by this method would be an eight line, nine reel video slot machine. While there are already machines of this type in operation, they all suffer from using the same reel mapping for all nine reels. By utilizing a method of having three separate reel maps and utilizing them in a manner that makes seven of the eight lines consist of one each of reel numbers 1, 2, and 3, it becomes possible to provide a reel strip that consists of a symbol at each and every reel position with no blanks on the strip. Current 8 line machines have many blanks on the reels, giving the player the impression that there are more ways to lose than with a full reel strip. The $8^{th}$ line would be made up of 3 copies of reel 3.

Not only would this type of game be more inviting to the player, but the methods of mapping reel positions for more than one purpose as described above would allow the machine to offer the same kind of "guaranteed winners" and "multiplier" features as well.

Other features that could be added to a nine reel game are the ability to pay off winners for hitting a particular number of identical symbols on a game without regard to whether they occupied the same line, or not. Thus six of a symbol being displayed in the game matrix at the same time could be made into a separate pay. With the possibility of winning in more than one manner, the game would become more attractive to the player.

Another feature that could be used on a nine reel game would be to offer a special reward for hitting some particular pattern of like symbols in the game matrix (such as the four corner reels or the four side reels having matching symbols, or in the form of an X or a cross "T" or "L" pattern). This reward could be in the form of an additional pay, or a re-spin of the center reel for a chance at another winner, or some other reward that the player would perceive as advantageous.

BRIEF DESCRIPTION OF THE DRAWINGS

FIG. 2 shows an example of a physical reel strip layout and the map clustering to correspond to the symbol presentation of the reels;

FIG. 3 shows the layout for the symbols of the reels for a 84.9% game;

FIGS. 4A–4C the symbol distribution, winning combinations and hit frequency calculation for a 85.87% base game is illustrated:

FIGS. 5–7 show the distribution of the various colored blanks are shown as is the hit frequency for each;

FIG. 8 shows a table regarding pays where the player wagers different amounts during a hot streak feature;

FIGS. 9–15 show and example of a three reel, 8 line game incorporating a hot streak phase according to the present invention;

FIG. 16 shows a scatter symbol bonus for the 8 line game;

FIG. 17 shows another bonus for the 8 line game; and

FIG. 18 shows yet another bonus feature for the game.

DESCRIPTION

1. Mechanical, Stepper Motor Games

Figure 1:
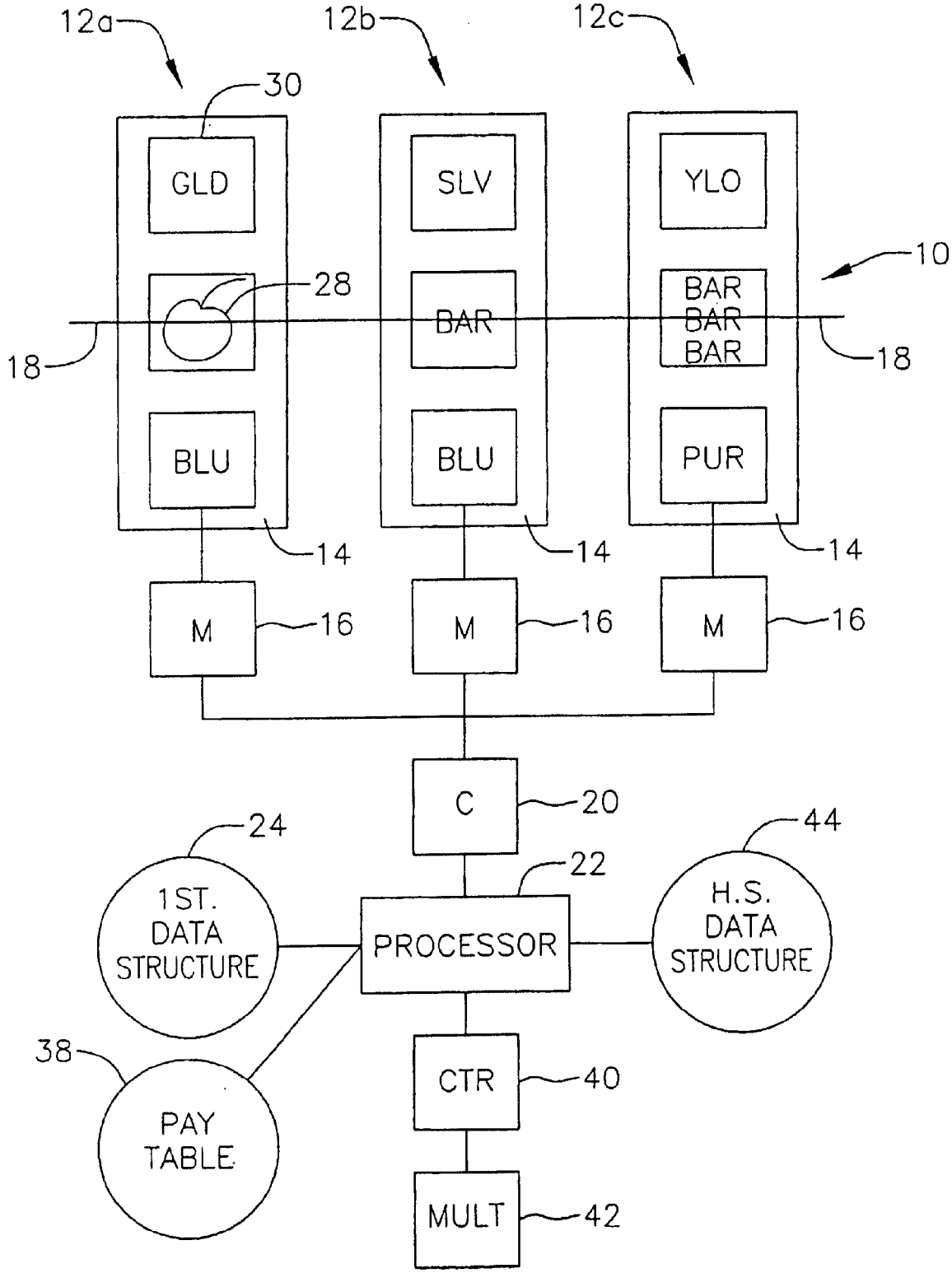
FIG. 1 illustrates a mechanical, three-reel, stepper motor game and control according to the present invention.

Turning to the drawings, FIG. 1 illustrates the operation and control of a stepper motor game 10 according to the present invention. As is known with respect to stepper motor games of the prior art, the game 10 includes three reels 12*a–c* which include at each of their peripheries, a plastic or velum reels strip 14 having imprinted thereon the symbols for the game. Each reel 12*a–c* is rotated and stopped under control of a stepper motor 16 to rotate and stop to present a symbol (or blank) at a pay line 18 defined for the game on a glass overlay. A controller 20 controls the motors 16 to rotate and stop the reels 12*a–c* as commanded by a processor 22.

As is known in the art, each reel 12*a–c*, in cooperation with the driving motor 16 and controller 20, is defined to have twenty-two stop positions, e.g. stops. At each stop there is an assigned symbol or blank. Unless otherwise stated, game symbols shall be understood to include blanks which are stop positions on the strips 14 having no symbols or, as hereinafter described with reference to the present invention, assigned colors with no symbol. Under control of the processor 22, the reels 12*a–c* are caused to rotate and to stop to align symbols on the pay line 18. Depending upon the pay line symbol combination, the outcome is a winning or a losing combination.

Not shown with respect to the game are means for a player to input a wager and to prompt play of the game inasmuch as the same are well known in the art. These means can include a coin or token receiver, a cash reader for the player to input cash or script to accumulate game credits, a credit meter, means for reading sums from a credit or debit card to accumulate gaming credits or the like.

The game includes a first data structure 24 which includes data corresponding to the symbols for the game 10 according to the present invention. With reference to FIG. 2 there is shown a reel strip layout 26 which describes the physical reel strip layout of the symbols and their stop positions on each reel strip 14 for each reel 12*a–c*. As can be appreciated from the layout 26 and the immutable nature of the physical reel strips 14, the symbols have a fixed, relative position or grouping as well as assigned stop positions. With reference to FIGS. 1 and 2, reel 12*a* is illustrated to display at the pay line 18 stop position 5 (Cherry symbol 28). Above stop position 5 is stop position 4, which is displayed as a gold blank 30 and below stop position 5 is stop position 6, a blue blank 32. For reel 12*b*, stop position 7 is displayed aligned at the pay line 18 and for reel 12*c* stop position 11 is aligned with the pay line 18. Thus it may be stated that each symbol has a stop position N (where $1<N<22$) and has adjacent symbols at positions N−1 (above) and N+1 (below).

With continuing reference to FIG. 2, there is also shown a symbol map 34, corresponding data of which would be stored in the first data structure 24. As shown, there are provided sixty-four addresses (A) in the data structure for each reel 12*a–c* and for each address position A there is symbol data representing a symbol on the reel strips 14. As can also be appreciated the first data structure 24 is configured such that the symbol data at the addresses correspond to the grouping or clustering of symbols on the reel strip layout 26. Thus the map data of the map 34 corresponds directly to the physical, mechanical reels 12*a–c*. For example, if address $A_5$ is selected for reel 12*a* (Reel 1), there is the cherry 28 and at adjacent address $A_4$ there is the gold blank 30 and at address $A_6$ there is the blue blank 32 thus corresponding the reel strip 14 positions $N_5$, $N_4$(N−1) and $N_8$ (N+1) for reel 12*a* as shown in FIG. 1. Also as shown in FIG. 2, in the map 34 to arrive at the desired symbol distribution, certain symbol groups are repeated to define the sixty-four addresses. At chart 36 the symbol distribution for the desired characteristics of the map 34 and overall game 10 is shown. Thus, to obtain the desired symbol distribution, for reel 12*a*, map address clusters corresponding to stop positions $N_{8-21}$ are repeated. For reels 12*b–c* there is a similar clustering to obtain the desired symbol distribution. Stop positions $N_{8-21}$ are repeated as are clusters $N_{14-21}$.

With reference to FIG. 3, clustering can also be accomplished by assembling the symbols to be used and constructing the desired symbol distribution and clustering and, from that, the physical reel strips layouts 26. For example, and with reference to Table A and the column noted as "Reel 1" it is seen that on the physical reel strip the Cherry 28 would be located at position $N_7$ and in the map would be represented at addresses $A_{15-16}$. Thus the quantity and distribution of symbols of the map 34 can be assembled. However according to this embodiment, the clustering is by symbol as opposed to stop positions discussed above with reference to FIG. 2.

The symbol distribution, winning combinations and hit frequency calculation for a 85.87% base game is illustrated in FIGS. 4A–C. Each winning combination is shown with the number of symbols on Reels 1–3 (reels 12*a–b*) and the frequency each outcome should occur (hits). By assigning a pay to each hit a theoretical win percentage contribution for each winning outcome can be calculated. All win percentage contributions are summed to define the overall pay (84.94%) for the base game. It is to be noted that FIGS. 4A–C show a slightly different symbol distribution than FIGS. 2–3 to, with assigned pays, configure the based game to have the desired hit frequency and pay percentage of 85.87%.

The first data structure 24 for the base game base game may be configured in the manner described above such as by arranging the data in clusters as suggested by FIG. 2 or 3. To define the winning symbol combinations and pays therefor (or hot streak multiplier triggers as hereinafter described), the game 10 includes a pay table data structure 38. For example, and with reference to FIG. 4A, the pay table data structure 38 would contain data that a symbol combination of "Double-Double-Double" is a winning combination entitled to a pay of 1000 (times the amount of the wager) and that three "Red 7*s*" is entitled to a pay of 100 times the amount of the wager. Each symbol combination aligned on the pay line 18 would be compared to the data stored in the pay table data structure 38 and if a winning combination has been obtained the processor 22 controls the game 10 to issue the corresponding award. In this regard the processor 22 may control a coin/token dispenser, credit meter, voucher printer, magnetic card reader or other means for issuing the award to the player as is known in the art.

Hot Streak Multiplier

A further feature of the present invention is that the game 10 is configured to have a multiplier feature. The multiplier feature does not alter the hit frequency for the base game but does, for a predetermined number of games, multiply winning outcome awards for the base game pay table. By providing a hot streak multiplier as hereinafter described, the overall pay of the base game, e.g. 84.94% may be increased depending upon one or more of several factors including (1)

the frequency at which the hot streak multiplier is triggered, (2) the number of games the hot streak multiplier persists and (3) the amount of the multiplier.

Turning to FIG. 5, there is a table showing an example of the distribution of certain color blanks for each of the three reels 12*a–c*. In lieu of using designated symbols, e.g. a color blank at a reel stop position, the colors used as hot streak triggers may instead be presented as non-blank symbols with color backgrounds, colored symbols, polka dots or the like. Further, the triggers may instead be configured as colors but may be numbers, letters, special symbols or the like. For purposes of explanation, the triggers shall be assumed to be colored blanks and the multiplier will be assumed to be double (2×). Other multipliers can be used and different multipliers may be adopted, either randomly selected or depending upon the triggering outcome.

With continuing reference to FIG. 5, the distribution of the various colored blanks are shown as is the hit frequency for each ("Hits" in FIG. 5), (1) the average pay (14.22) for each base game winning combination, the number of games the multiplier persists (2 consecutive games) and the overall contribution of the hot streak multiplier to the overall pay percentage for the game. Thus, and with reference to FIGS. 1, and 2–5, the play of the game 10 with a hot streak multiplier will now be described.

The player makes a wager, e.g. three units, and prompts play of the game. Upon prompting of play the game may be in a hot streak phase, however, for purposes of explanation it shall be assumed that there is no persisting multiplier feature. The processor 22, with a random number generator, randomly selects an outcome address (A) for each reel 12*a–c* from the data stored in the first data structure 24 and controls the controller 20 to control the reel motors 16 to rotate and stop to display the selected outcome. The processor 22 compares the data corresponding to the outcome to the data stored in the pay table data structure 38 to determine if the player has obtained a winning outcome (or a multiplier trigger) for the game 10. If the player has obtained a base game winning outcome, the player is issued the corresponding award. If no winning combination for the base game has been obtained, the player's wager is lost. The player may then make another wager and play the next hand (spin).

In the event the player has obtained a trigger outcome, e.g. three gold blanks on the pay line 18, the hot streak multiplier feature is triggered. The processor 22 starts a counter and for the allocated hot streak multiplier games, e.g. 2, all winning outcome awards are doubled by a multiplier. It should be noted that during the hot streak configuration, the player must input wagers to play the games, just as in the base game. If, during a hot streak game, the player hits another trigger, the counter 40 is re-configured to add two more hot streak games to the counter 40. Thus, the player may increase the number of hot streak multiplier games by obtaining more triggers. The game 10 may include a sign or other indicator to inform the player that they are in the hot streak and the number of hot streak games in the counter. As the player plays hot streak games the counter 40 is decreased until the number of games is exhausted returning the player to the base game with no multiplier.

As stated above, by configuring the triggers, trigger hit frequency and number of hot streak games, the pay percentage of the game 10 can be adjusted to the desired percentage.

If desired, a pay may be provided for obtaining a trigger outcome in addition to the outcome triggering the hot streak multiplier for the game 10. The trigger pays may also be used to adjust the pay percentage for the game 10 to the desired amount.

FIGS. 5–7 illustrate that by adjusting the number of hot streak games, the overall pay percentage for the game 10 can be adjusted to the desired amount.

To prevent players from wagering the minimum until a hot streak trigger is obtained and then wagering the maximum, wagers can be allocated as suggested in FIG. 8. This figure tabulates, for various multipliers (2×–10×), the award multiplier where the player has made a wager and hit the trigger and during the hot streak games, alters their wager.

Hot Streak Wins

In an additional or alternative embodiment, when the player obtains a hot streak trigger outcome, e.g. three gold blanks on the pay line 18, the processor 22 may re-configure the first data structure 24 or, for the allotted number of hot streak games, access a hot streak data structure 44 (FIG. 1), providing for the succeeding hot streak games, in addition to the awards for the base game, an award for any symbol for the third reel 12*c* aligned at the pay line 18. Thus, in the outcome based hot streak configuration, prior losing outcomes are now winning outcomes. During this phase, the player cannot lose inasmuch as every outcome includes an award. Again, as with the hot streak multiplier, the number of hot streak games can be increased if the player obtains more trigger outcomes. The consecutive wins during the hot streak phase increases player interest in the game and draws attention to the game. As the player wagers for the next game, he/she is assured during the hot streak phase that they will obtain a winning outcome. Further the player is unlikely to leave the game 10 during a hot streak phase.

By configuring the number of hot streak games and pays for symbols, the contribution of the hot streak phase to the overall game hold can be configured.

Thus the hot streak feature permits the game 10 designer to configure the game pay out percentage without altering the features of the base game. Further the hot streak phase increases player interest and satisfaction with the game 10.

To prevent the player from wagering a minimum amount and then increasing the wager during the hot streak phase, like for the hot streak multiplier, only the amount wagered when the trigger was hit will be allocated to the hot streak affect in the manner described above with reference to FIG. 8.

The aforementioned embodiments of the invention for stepper motor games may be incorporated into four and five reel games and games with multiple, e.g. three, pay lines. Where multiple pay lines are used, when a trigger outcome occurs on that pay line, the hot streak feature is applied to that pay line for the allotted number of games.

Further, the features described above may be incorporated into video games simulating stepper games, such as hand held novelty games, video slot machines and the like.

2. Video Slot Machines

Turning to FIGS. 9–15 another game according to the present invention is described for a three reel, eight pay line, video slot machine game 50 is shown. Preferably, game 50 is embodied as a video slot machine.

To configure the game according to the present invention, a 3×3 display matrix 52 is provided at a video display and is controlled by a processor 22. The matrix defines nine coordinates 54*a–i* arranged in three horizontal rows and vertical columns. The game display also provides eight pay lines 56*a–h* designated, respectively, as "Lines 1–8" in FIG.

8 embracing three horizontal, three vertical and three diagonal pay lines 56*a–h* as shown.

To provide for the selection and display of game symbols for each coordinate 54*a–i* into the matrix 52, the game treats each coordinate 54*a–i* as if it were a separate, mechanical, stepper motor reel. It is believed that 3×3 games have been developed and are being used in the casino market; however these games treat every coordinate in the matrix as an identical stepper motor reel with a plurality of stops; primarily to simplify the mathematical analysis for the game. These prior games have vertical, horizontal and diagonal pay lines.

Returning to the present invention, the game 50 includes a first data structure storing data corresponding to the game symbols for each reel in a manner described above. It should be noted that reel strip clustering as described above with reference to FIG. 2 may not be employed inasmuch as there are no physical, fixed, symbol relationship, reel strips as there is for a stepper motor game and because the vertical pay lines and the arrangement of the reels for the coordinates 54*a–i* precludes the same. Thus, for the game 10, clustering is not required or desired.

It should be noted that in relation to matrix 52 and coordinates 54*a–i*, certain gaming machines of the prior art (other than that described above) have treated reel-type video games like stepper motor games. That is, the vertical columns of three coordinates each have been treated like three stepper motor reels for the selection and display of game. That is, the thinking has been in the construction and analysis of prior games, to mimic a three reel game and to arrange the data in the data structure into three reels and to select three data addresses for each reel. Along these lines, it has been a conceptual antithesis to use vertical pay lines since the same could not be used in a stepper motor game inasmuch as the symbol positions on a physical reel strip are fixed.

Still further, abandonment of the stepper motor game approach has complicated game construction since treating each coordinate as a separate reel requires a different hit frequency, pay and win percentage calculation for each of the different pay lines.

Figure 9:
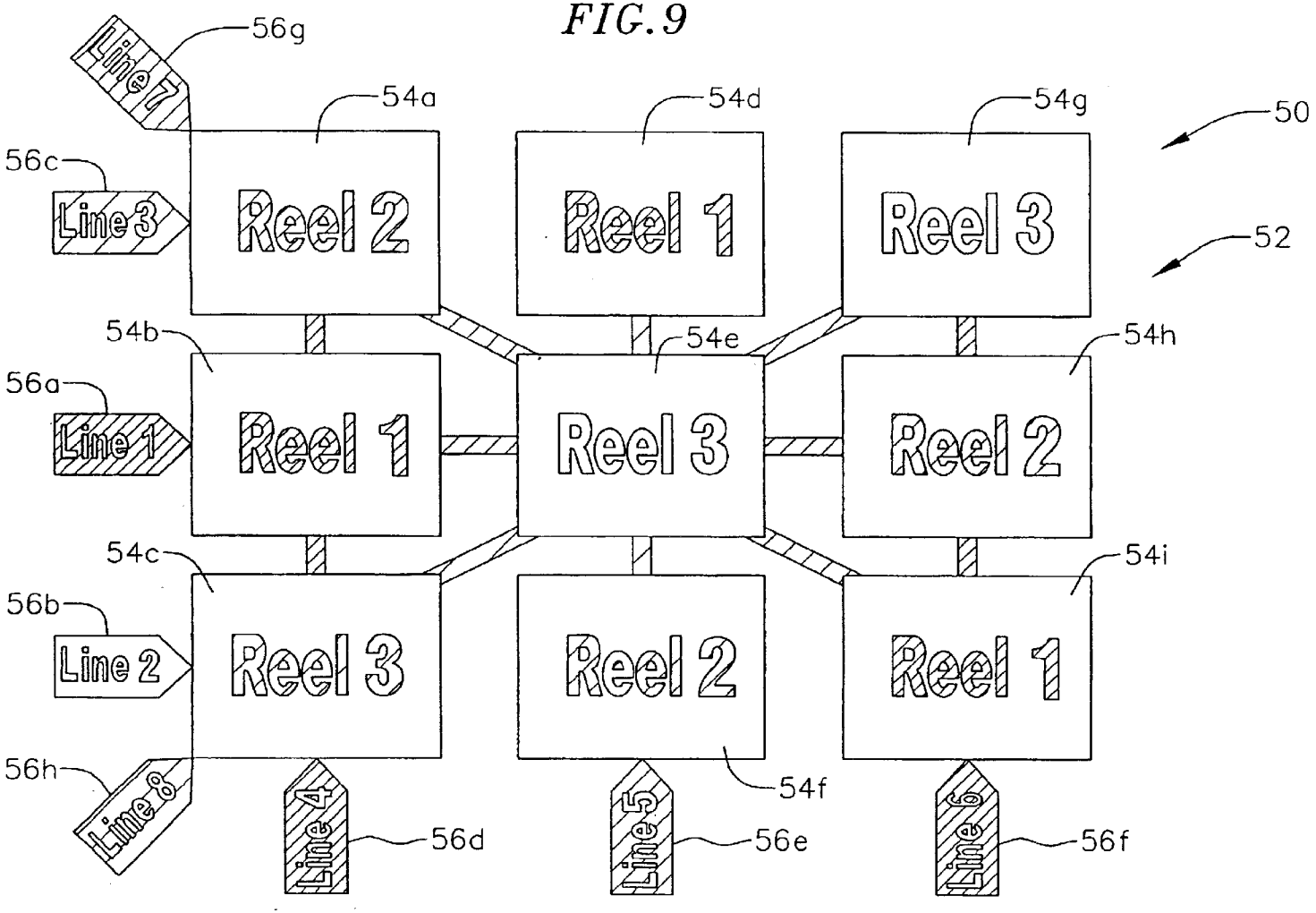

According to the present invention, to provide for the 3×3, eight pay line, game 50, the first data structure includes data corresponding to three data maps, each representing addresses $A_{1-X}$, where X=64. "X" may be any other number, however for purposes of explanation, it will be assumed that there are 64 addresses like in the map for a stepper motor game to correspond to the description above. As shown in FIGS. 9 and 10, each data map is assigned a reel number for a total of three "virtual" reels 58*a–c* (referred to as "Reels 1, 2 and 3") each having sixty-four addresses $A_{1-64}$ each referencing data representing a game symbol thus defining a virtual, a sixty-four stop, reel. An example of the symbol distribution for Reels 1, 2 and 3 (58*a–c*) is shown in Table 1 of FIG. 9 for a 79.86% base game and in Table 2 the hit frequency is shown for three Reel 3*s* (58*c*) representing a 80.85% base game.

With reference to the matrix 52 coordinates 54*b*, the reels 58*a–c* are presented according to the following Table 3 and as shown in FIG. 8;

TABLE 3

| Reel | Matrix Coordinates |
|---|---|
| 1 (58a) | 54b, 54d, 54i |
| 2 (58b) | 54a, 54f, 54h |
| 3 (58c) | 54c, 54e, 54g |

As further shown in FIG. 9, all pay lines 56*a–f* intersect all three reels 58*a–c*, with pay line 56*h* (Line 8) only intersecting data presented from reels 58*c* (Reel3).

With the arrangement described above, the hit frequency (%) for each of the pay lines 56*a–h* can easily be calculated since, Lines 1–7 (pay lines 56*a–g*) are duplicates (Reels 1–3) with Line 8 (pay line 56 *h*) being the only different calculation. The 79.86% hit frequency therefor, as shown in FIG. 9, applies to pay lines 56 *a–g* (Lines 1–7) with the frequency of 80.85% for Line b pay line 56*h*. Based upon the foregoing arrangement of the three data maps, the 3×3, eight pay line game can be configured and the hit frequencies easily calculated.

With reference to FIGS. 11–15, the hot streak feature of the present invention can be incorporated into the game 50. In the example of FIG. 11, there are twenty-two triggers, each identified by a distinguishing color. As stated above, the triggers may be other symbols such as numbers, letters, color attributes of base game symbols, color backgrounds or any other indication with a displayed symbol to indicate the trigger feature attributed to the symbol display. For example, each base game symbol may have a secondary symbol or display representing a trigger function.

The use of applying to each game symbol or stepper game stop position may also be applied to stepper games. That is, at any stop position there is a symbol attribute relative to the base game, e.g. a "Bar" symbol and a trigger attribute, e.g. a blue background.

The distribution of the triggers for each data map of the first data structure is shown in FIG. 10. With the trigger symbol distribution of FIG. 11, the trigger symbol hit frequency and average pay can be determined as is shown in FIGS. 12–15. Again, since all pay lines 56*a–g* are the same the calculation of the hit frequency is the same with that for Line 8 (line 56*h*) being treated as three Reel 3*s*.

According to the present invention, when a trigger outcome occurs on a pay line 56*a–h*, that pay line 56*a–h* is configured by the processor to be in a hot streak multiplier phase where, for a number of games, any award for a base game winning outcome is multiplied by a predetermined factor, e.g. 2×. As games are played the number of games is decremented by a counter until the hot streak game number expires. As above, if during a hot streak phase the player obtains a hot streak trigger for the pay line 56*a–h*, the allotted number of hot streak games is increased.

Thus, since the hot steak phase is applied by pay line, there may be one or several pay lines 56*a–h* where the hot streak phase persists. Each phase "turns on" and "turns off" based upon the number of games allotted to the phase and the number of games played during the phase.

FIGS. 13–14 show an example of the number of games the multiplier feature (2× pay for any winning combinations) will persist and the contribution to the overall game. For example, for Line 1 (line 56*a*), and based upon the number of hot streak games selected, the hot streak multiplier contributes an additional 1.89% to the base game of 79.86%. For the other pay lines 56*b–h*, by selecting the number of games the 2× pay is applied to that pay line 56*a–h*, the contribution from each pay line 56*a–h* to the base game can be determined.

FIG. 15 shows an increased contribution for Line 8 (56*h*) by increasing the number of hot streak allotted games from sixty-nine (FIG. 13) to one hundred and five games.

If desired, and according to another embodiment of the present invention, the game 50 may include contributions from scatter pays, matrix pattern re-spins or bonus pays.

With reference to FIG. 16, there is shown an example of pays for obtaining certain numbers of like symbols in the game matrix 52. For example, if the player obtains nine Stars (one at each coordinate 54*a–i*), they would receive a pay of one thousand times their wager. There is also shown in FIG. 16 a Table 6 showing certain bonus pays for line combinations. Tables 7 and 8 show certain scatter Bonus symbol pays. FIG. 17 shows a bonus selection wheel 60. If the player obtains any scattered tow Bonus symbols, a display shows the wheel 60 as well as the various outcomes. The processor randomly selects the wheel outcome and an arrow of the wheel 60 indicates the selected outcome and bonus to be awarded according to Table 7. If three or more Bonus symbols are selected, the processor randomly selects a pay from the Table and controls the display f the wheel 60 to indicate the award.

FIG. 18 shows a matrix pattern bonus. In the event the 7*s* or other selected symbol is selected and displayed in the matrix 52 in one of the two patterns shown, the processor is configured to display a free, re-spinning of the center coordinate 54*e* to produce either a winning or losing outcome.

To indicate which pay lines 56*h* are in the hot streak mode, the pay line may be highlighted and a counter provided for each to show the player where the hot streak is turned on and the number of hot streak games remaining.

The game 50 thus provides the following features. First, it uses three different symbol maps and yet configures a 3×3 matrix for which the calculation of the hit frequency and hold can be easily calculated. Because different maps are used, the maps need not include a lot of blanks. Further the game provides a hot streak feature wherein, a multiplier feature can be turned on and off for pay lines for the game. The game also has other features such as scatter pays, bonus awards and pattern re-spin features. These features, can be combined to produce the desired configuration of the game such as hit frequency and hold percentage. Further these features produce an exciting game where line multipliers are turning on and off, where awards are multiplied and where bonuses are awarded.

3. Video Poker

For Video Poker the game could be embodied such that certain outcomes of the base game define triggers, e.g. four cards to the Royal Flush, Straight Flush, or the like. When the game is triggered, the data structure representing the deck of cards is augmented by a data set for a predetermined number of games to increase the player's chances for obtaining at least one and preferably a plurality of certain outcomes. For example, the augmenting data set could be data representing twenty additional cards of Ace —10 for each suit thus increasing the player's probability to obtain a Royal Flush.

Alternatively, the pay table for the game could be altered to make certain heretofore losing combinations, winning combinations. For example, for a predetermined number of games, deuces may be wild with the pay schedule remaining the same thus, during the hot streak, providing more winning outcomes for the player. Thus, during the hot streak, the player either has a greater, statistical probability for obtaining a winning outcome without alteration of the overall pay table for the game. During the hot streak, the device may have a pay out of over 100% which increases the excitement for the player.

Thus a hot streak feature may be injected into a Video Poker game.

While I have shown and described certain embodiments of the device and method, it should be understood that it can be changed without departing from the spirit and scope of the description above. As can be appreciated the game can be played with three or more reels and multiple pay lines. Pay schedules would change from those described herein if the machine were a three reel machine, four reel machine or other multi-reel machine. Further other multiplier triggers may be used.

I claim:

1. A slot machine game comprising:

a display to display at least three reels and at least one pay line;

a computer processor including a first data storing map data for each reel corresponding to game symbols and a second data structure storing data corresponding to winning symbol outcomes and awards, wherein each reel is a physical reel having a reel strip with a fixed number N symbols in a fixed order, said first data structure configured to have data address positions A, wherein A>N and where data in adjacent address positions A correspond with said symbol order on said reel strips;

means for a player to input a wager to enable at least one pay line and prompt play of a game;

said processor configured to, in response to prompting of play to randomly select from each reel map data symbols for each pay line and a trigger or non-trigger condition and to control said display to display the selections for each reel;

said processor configured to compare said displayed game symbols on each enabled pay line to the data of said second data structure to determine the display of any winning symbol combinations and to issue an award for any designated winning symbol combination;

said processor configured to determine for each enabled pay line the selection of a trigger condition and in response thereto re-configuring of at least one of (1) the second data structure winning combinations and/or (2) the award for at least one winning combination for a predetermined number of future games.

2. The game of claim 1 including said data structure including first map data for one reel and second map data for a second reel, said first and second map data sets including data representing different distribution of game symbols.

3. The game of claim 1 further including said processor configured to indicate reconfiguration.

4. A method for configuring a slot machine stepper motor game of the type having at least three physical reels each having about their periphery a strip displaying N symbols in a fixed relationship each disposed at a reel stop position and at least one pay line, the rotation and stopping of reels to present symbols at each pay line to define an outcome, said method comprising:

providing a processor to control said stepper motors, a first data structure having for each reel a set of A data addresses storing data corresponding to said game symbols and where data in adjacent address positions A correspond with said symbol order for said reels, where A>N and a second data structure storing data corresponding to winning symbol combinations and the award for each;

the player entering a wager to activate at least one pay line and prompt play;

the processor in response to prompting, selecting addresses for the reels and controlling the stepper motors to rotate the reels and display the symbols, said displayed symbols aligned on each pay line defining an outcome and said processor selecting between a trigger and a non-trigger condition for each pay line;

the processor comparing each outcome to the data of said second data structure and if the outcome is a winning outcome, issuing an award to the player; and if the processor detects selection of a trigger condition on an enabled pay line, re-configuring of at least one of (1) the second data structure of winning outcomes and/or (2) the award for at least one winning outcome for a predetermined number of future games.

5. The method of claim 4 comprising designating an outcome including at least one designated symbol as a trigger condition and if the processor detects an outcome including a symbol including a trigger designation on an enabled pay line, for a predetermined number of future games reconfiguring the second data structure to provide an award based upon any displayed symbol.

6. The method of claim 5 comprising if the processor detects an outcome including a symbol including a trigger designation on an enabled pay line, the second data structure configured to provide, for a predetermined number of future games and for the pay line including said trigger condition, an award based upon any displayed symbol on a selected reel.

7. A method for configuring a video slot machine game of the type having a 3×3 display matrix defining a nine reel, eight pay line game, said pay lines each including three coordinates of the game matrix, the combination of game symbols selected and displayed along each pay line defining winning or losing outcomes, the method comprising:

providing a processor and data structure storing three sets of game symbol data, one set for each of three reels 1–3;

providing a game display to display said game matrix;

assigning to each coordinate a set of game symbol data such that for seven pay lines each includes data sets corresponding to reels 1–3 and for the eighth pay line the data set corresponding three reel 3*s;* the player making a wager to enable one or more pay lines and prompting play of the game;

said processor in response to prompting of play randomly selecting from said data sets data representing three game symbols and controlling the display to display said data at said coordinates according to the assignment of said reels defining an outcome; and said processor comparing the symbols aligned on each enabled pay line to data representing winning symbol combinations and for each winning combination issuing an award to the player.

8. The method of claim 7 comprising the assignment data sets to the matrix is Reel 2 Reel 1 Reel 3

Reel 1 Reel 3 Reel 2

Reel 3 Reel 2 Reel 1.

9. The method of claim 8 comprising assigning a trigger designation to at least one game symbol, said processor detecting the selection and display of said symbol including said trigger designation and in response thereto applying a multiplier to awards for a predetermined number of future games.

10. The method of claim 9 comprising said processor, for the pay line including said displayed symbol including said trigger designation and for a predetermined number of future games, applying a multiplier to any awards for winning symbol combinations on said pay line.

11. The method of claim 10 comprising said processor detecting for a game the display of at least a predetermined number of like symbols in the display and issuing an award therefor.

12. The method of claim 10 comprising said processor detecting for a game the display of like symbols in at least one predetermined pattern in said matrix and in response thereto providing re-selection and display of data for at least one coordinate.

13. A video slot machine device of the type having a video display to display a game matrix defining a nine reel, eight pay line game, said pay lines each including three coordinates of the game matrix, the combination of game symbols selected and displayed along each pay line defining winning or losing outcomes, the device comprising:

a processor and data structure storing three sets of game symbol data, one set for each of three reels 1–3, said processor configured to assign to each coordinate a set of game symbol data such that for seven pay lines each includes data sets corresponding to reels 1–3 and for the eighth pay line the data set corresponding three reel 3*s;* means for a player to make a wager to enable one or more pay lines and prompting play of the game;

said processor configured to, in response to prompting of play, randomly select from said data sets data representing three game symbols and control the display to display said data at said coordinates according to the assignment of said reels defining an outcome; and said processor configured to compare the symbols aligned on each enabled pay line to data representing winning symbol combinations and for each winning combination issuing an award to the player.

* * * * *